US011020962B2

(12) United States Patent
Nakano et al.

(10) Patent No.: US 11,020,962 B2
(45) Date of Patent: Jun. 1, 2021

(54) LIQUID EJECTION APPARATUS

(71) Applicant: Brother Kogyo Kabushiki Kaisha, Nagoya (JP)

(72) Inventors: Yasuhiro Nakano, Nagoya (JP); Zenichiro Sasaki, Nagoya (JP); Yuta Toda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 16/857,525

(22) Filed: Apr. 24, 2020

(65) Prior Publication Data

US 2020/0338884 A1 Oct. 29, 2020

(30) Foreign Application Priority Data

Apr. 26, 2019 (JP) ..... JP2019-086069

(51) Int. Cl.
*B41J 2/045* (2006.01)
*B41J 2/165* (2006.01)

(52) U.S. Cl.
CPC ..... *B41J 2/0451* (2013.01); *B41J 2/0458* (2013.01); *B41J 2/04581* (2013.01); *B41J 2/16508* (2013.01); *B41J 2/16532* (2013.01); *B41J 2/16579* (2013.01)

(58) Field of Classification Search
CPC .... B41J 2/0451; B41J 2/0458; B41J 2/04581; B41J 2/16508; B41J 2/16532; B41J 2/16579
See application file for complete search history.

(56) References Cited

U.S. PATENT DOCUMENTS

2007/0139461 A1 6/2007 Izuo
2012/0249670 A1* 10/2012 Sugahara ..... B41J 2/16526 347/26
2014/0300657 A1 10/2014 Ike
2014/0375718 A1* 12/2014 Govyadinov ..... B41J 2/0458 347/14

FOREIGN PATENT DOCUMENTS

JP 2008-036989 A 2/2008
JP 4929699 B2 5/2012
JP 2013-103464 A 5/2013
JP 6231759 B2 11/2017

* cited by examiner

*Primary Examiner* — Anh T Vo
(74) *Attorney, Agent, or Firm* — Banner & Witcoff, Ltd.

(57) ABSTRACT

A liquid ejection apparatus is provided, comprising a liquid ejection head, a signal output circuit which outputs different signals depending on the number of ejection-defective nozzles in which any defective discharge of a liquid occurs, and a controller. The controller executes judgment to judge whether a first condition that any ejection-defective nozzle is absent in two or more nozzles for constructing a first nozzle group is satisfied, a second condition that all of the nozzles are the ejection-defective nozzles is satisfied, or a third condition that only some of the nozzles are the ejection-defective nozzles is satisfied, on the basis of the signal outputted from the signal output circuit.

24 Claims, 20 Drawing Sheets

Fig. 10A

| NOZZLE GROUP | NOZZLE | JUDGMENT RESULT |
|---|---|---|
| G11 | n1 | +++ |
| | n2 | |
| G12 | n3 | ++ |
| | n4 | |
| G13 | n5 | + |
| | n6 | |
| G14 | n7 | ++ |
| | n8 | |
| G15 | n9 | ++ |
| | n10 | |
| G16 | n11 | ++ |
| | n12 | |
| G17 | n13 | +++ |
| | n14 | |
| G18 | n15 | ++ |
| | n16 | |
| G19 | n17 | ++ |
| | n18 | |

Fig. 10B

| NOZZLE GROUP | NOZZLE | JUDGMENT RESULT |
|---|---|---|
| G21 | n3 | +++ |
| | n7 | |
| G22 | n9 | ++ |
| | n11 | |
| G23 | n15 | ++ |
| | n17 | |

Fig. 10C

| NOZZLE GROUP | NOZZLE | JUDGMENT RESULT |
|---|---|---|
| G31 | n9 | ++ |
| | n15 | |

Fig. 10D

| NOZZLE | JUDGMENT RESULT |
|---|---|
| n9 | DEFECTIVE DISCHARGE |

Fig. 10E

| NOZZLE | JUDGMENT RESULT | NOZZLE | JUDGMENT RESULT |
|---|---|---|---|
| n1 | NORMAL | n10 | NORMAL |
| n2 | NORMAL | n11 | NORMAL |
| n3 | NORMAL | n12 | DEFECTIVE DISCHARGE |
| n4 | DEFECTIVE DISCHARGE | n13 | NORMAL |
| n5 | DEFECTIVE DISCHARGE | n14 | NORMAL |
| n6 | DEFECTIVE DISCHARGE | n15 | NORMAL |
| n7 | NORMAL | n16 | DEFECTIVE DISCHARGE |
| n8 | DEFECTIVE DISCHARGE | n17 | DEFECTIVE DISCHARGE |
| n9 | DEFECTIVE DISCHARGE | n18 | NORMAL |

Fig. 11A

| NOZZLE GROUP | NOZZLE | JUDGMENT RESULT |
|---|---|---|
| G11 | n1 | +++ |
| | n2 | |
| | n3 | |
| G12 | n4 | ++ (2) |
| | n5 | |
| | n6 | |
| G13 | n7 | + |
| | n8 | |
| | n9 | |
| G14 | n10 | ++ (1) |
| | n11 | |
| | n12 | |
| G15 | n13 | ++ (2) |
| | n14 | |
| | n15 | |
| G16 | n16 | +++ |
| | n17 | |
| | n18 | |

Fig. 11B

| NOZZLE GROUP | NOZZLE | JUDGMENT RESULT |
|---|---|---|
| G21 | n4 | ++ (1) |
| | n10 | |
| | n13 | |
| G22 | n5 | ++ (2) |
| | n11 | |
| | n14 | |

Fig. 11C

| NOZZLE GROUP | NOZZLE | JUDGMENT RESULT |
|---|---|---|
| G31 | n5 | ++ (1) |
| | n10 | |
| | n14 | |

Fig. 11D

| NOZZLE | JUDGMENT RESULT |
|---|---|
| n13 | NORMAL |

Fig. 11E

| NOZZLE | JUDGMENT RESULT |
|---|---|
| n5 | NORMAL |
| n10 | NORMAL |

Fig. 11F

| NOZZLE | JUDGMENT RESULT | NOZZLE | JUDGMENT RESULT |
|---|---|---|---|
| n1 | NORMAL | n10 | NORMAL |
| n2 | NORMAL | n11 | DEFECTIVE DISCHARGE |
| n3 | NORMAL | n12 | NORMAL |
| n4 | DEFECTIVE DISCHARGE | n13 | NORMAL |
| n5 | NORMAL | n14 | DEFECTIVE DISCHARGE |
| n6 | DEFECTIVE DISCHARGE | n15 | DEFECTIVE DISCHARGE |
| n7 | DEFECTIVE DISCHARGE | n16 | NORMAL |
| n8 | DEFECTIVE DISCHARGE | n17 | NORMAL |
| n9 | DEFECTIVE DISCHARGE | n18 | NORMAL |

Fig. 14A

| NOZZLE GROUP | NOZZLE | JUDGMENT RESULT |
|---|---|---|
| G11 | n1 | +++ |
| | n2 | |
| | n3 | |
| G12 | n4 | ++ |
| | n5 | |
| | n6 | |
| G13 | n7 | + |
| | n8 | |
| | n9 | |
| G14 | n10 | ++ |
| | n11 | |
| | n12 | |
| G15 | n13 | ++ |
| | n14 | |
| | n15 | |
| G16 | n16 | +++ |
| | n17 | |
| | n18 | |

Fig. 14B

| NOZZLE GROUP | NOZZLE | JUDGMENT RESULT |
|---|---|---|
| G21 | n4 | ++ |
| | n10 | |
| G22 | n5 | +++ |
| | n13 | |
| G23 | n6 | + |
| | n11 | |
| G24 | n12 | ++ |
| | n14 | |

Fig. 14C

| NOZZLE | JUDGMENT RESULT |
|---|---|
| n15 | DEFECTIVE DISCHARGE |

Fig. 14D

| NOZZLE GROUP | NOZZLE | JUDGMENT RESULT |
|---|---|---|
| G31 | n4 | ++ |
| | n12 | |

Fig. 14E

| NOZZLE | JUDGMENT RESULT |
|---|---|
| n4 | DEFECTIVE DISCHARGE |

Fig. 14F

| NOZZLE | JUDGMENT RESULT | NOZZLE | JUDGMENT RESULT |
|---|---|---|---|
| n1 | NORMAL | n10 | NORMAL |
| n2 | NORMAL | n11 | DEFECTIVE DISCHARGE |
| n3 | NORMAL | n12 | NORMAL |
| n4 | DEFECTIVE DISCHARGE | n13 | NORMAL |
| n5 | NORMAL | n14 | DEFECTIVE DISCHARGE |
| n6 | DEFECTIVE DISCHARGE | n15 | DEFECTIVE DISCHARGE |
| n7 | DEFECTIVE DISCHARGE | n16 | NORMAL |
| n8 | DEFECTIVE DISCHARGE | n17 | NORMAL |
| n9 | DEFECTIVE DISCHARGE | n18 | NORMAL |

LIQUID EJECTION APPARATUS

CROSS REFERENCE TO RELATED APPLICATION

The present application claims priority from Japanese Patent Application No. 2019-086069 filed on Apr. 26, 2019, the disclosure of which is incorporated herein by reference in its entirety.

BACKGROUND

Field of the Invention

The present disclosure relates to a liquid ejection apparatus for ejecting a liquid from nozzles.

Description of the Related Art

A printer, which performs the recording by ejecting an ink from nozzles, is known as an example of the liquid ejection apparatus for ejecting the liquid from the nozzles. In the case of the certain known printer, a head is driven so that the ink is ejected from the nozzles. It is judged whether or not the ink is ejected from the nozzles on the basis of the change in the electric potential brought about on a detecting electrode in this situation.

SUMMARY

In the case of the known printer described above, the head is driven so that the ink is ejected from the nozzles individually for each of the plurality of nozzles of the head in order to distinguish whether or not the ink is ejected in relation to each of the plurality of nozzles of the head. Then, the following operation is performed. That is, it is judged whether or not the ink is ejected from the nozzle on the basis of the change in the electric potential brought about on the detecting electrode in this situation. On this account, if the number of the nozzles of the head is large, then the head is driven a large number of times in order to judge whether or not the ink is ejected from all of the nozzles, and a long time is consequently required to perform the judgment.

An object of the present disclosure is to provide a liquid ejection apparatus which makes it possible to maximally shorten the time required to judge whether or not a nozzle is a ejection-defective nozzle that involves any abnormality to eject a liquid, in relation to each of a plurality of nozzles of a liquid ejection head.

According to an aspect of the present disclosure, there is provided a liquid ejection apparatus including: a liquid ejection head including a plurality of nozzles forming a plurality of first nozzle groups, each of the first nozzle groups including two or more nozzles of the plurality of nozzles; a signal output circuit configured to output a signal in response to a discharge of a liquid from a nozzle of the plurality of the nozzles, a signal in response to a normal discharge of the liquid being different from a signal in response to a defective discharge of the liquid, and in a case that the liquid is simultaneously ejected from two or more nozzles of the plurality of nozzles, the signal output circuit being configured to output different signals depending on the number of ejection-defective nozzles that undergo occurrence of the defective discharge of the liquid; and a controller. The controller is configured to: drive the liquid ejection head such that the liquid is simultaneously ejected from the two or more nozzles in each of the first nozzle groups, and; judge, based on the signal output from the signal output circuit, whether a first condition, a second condition or a third condition is satisfied, the first condition being a condition in which the ejection-defective nozzles are absent in the two or more nozzles of each of the first nozzle groups, the second condition being a condition in which all of the two or more nozzles of each of the first nozzle groups are the ejection-defective nozzles, and the third condition being the condition in which a part of the two or more nozzles of each of the first nozzle groups are the ejection-defective nozzles. In a case that the controller judges that two or more first nozzle groups in the first nozzle groups satisfy the third condition, the controller is configured to: classify at least some of the nozzles in the two or more first nozzle groups that satisfy the third condition, into at least one second nozzle group, each of the at least one second nozzle group including two or more nozzles and having a different combination of the nozzles as compared with the plurality of first nozzle groups; drive the liquid ejection head such that the liquid is simultaneously ejected from the two or more nozzles of each of the at least one second nozzle group; and judge, based on the signal output from the signal output circuit, whether the first condition is satisfied, the second condition is satisfied, or the third condition is satisfied.

It is understood that all of the nozzles, which constitute the first nozzle group that satisfies the first condition, are not the ejection-defective nozzles. Further, it is understood that all of the nozzles, which constitute the first nozzle group that satisfies the second condition, are the ejection-defective nozzles. Then, as for the first nozzle group which satisfies the first condition or the second condition, it is possible to decrease the number of times of the driving the liquid ejection head required to judge whether or not the nozzle is the ejection-defective nozzle, as compared with a case in which it is judged whether or not the nozzle is the ejection-defective nozzle by driving the liquid ejection head so that the liquid is ejected individually from each of the nozzles.

Further, if the plurality of nozzle groups, which satisfy the third condition, are present, the nozzles, each of which is obtained by excluding one of the two or more nozzles in relation to each of the plurality of first nozzle groups that satisfy the third condition, are classified into the plurality of second nozzle groups, while changing the combinations of the nozzles as compared with the plurality of first nozzle groups. It is understood that all of the nozzles, which constitute the second nozzle group that satisfies the first condition, are not the ejection-defective nozzles. Further, it is understood that all of the nozzles, which constitute the second nozzle group that satisfies the second condition, are the ejection-defective nozzles.

Then, as for the second nozzle group which satisfies the first condition or the second condition, it is possible to decrease the number of times of the driving of the liquid ejection head required to judge whether or not the nozzle is the ejection-defective nozzle, as compared with a case in which it is judged whether or not the nozzle is the ejection-defective nozzle by driving the liquid ejection head so that the liquid is ejected individually from each of the nozzles.

Note that if only one first nozzle group that satisfies the third condition and/or if only one second nozzle group that satisfies the third condition is/are present, it is possible to judge whether or not the nozzle is the ejection-defective nozzle by ejecting the liquid from at least a part or parts of the nozzle or nozzles for constructing the nozzle groups.

According to the fact as described above, the present disclosure makes it possible to maximally decrease the number of times of the driving of the liquid ejection head required to judge whether or not the nozzles are the ejection-defective nozzles.

BRIEF DESCRIPTION OF THE DRAWINGS

FIG. 10A explains first nozzle groups and judgment results thereof in an example, FIG. 10B explains second nozzle groups and judgment results thereof in the example, FIG. 10C explains a third nozzle group and a judgment result thereof in the example, FIG. 10D explains a judgment result obtained when the ink is ejected from one nozzle of the third nozzle group in the example, and FIG. 10E explains judgment results to indicate whether or not each of the nozzles is the ejection-defective nozzle, as obtained from the judgment results depicted in FIGS. 10A to 10D.

FIG. 11A explains first nozzle groups and judgment results thereof in another example, FIG. 11B explains second nozzle groups and judgment results thereof in the another example, FIG. 11C explains a third nozzle group and a judgment result thereof in the another example, FIG. 11D explains a judgment result obtained when the ink is ejected from a remainder nozzle left over in the third group grouping process in the another example, FIG. 11E explains judgment results obtained when the ink is individually ejected from two nozzles of the third nozzle group in the another example, and FIG. 11F explains judgment results to indicate whether or not each of the nozzles is the ejection-defective nozzle, as obtained from the judgment results depicted in FIGS. 11A to 11E.

FIG. 14A explains first nozzle groups and judgment results thereof in an example of the second embodiment, FIG. 14B explains second nozzle groups and judgment results thereof in the example of the second embodiment, FIG. 14C explains a judgment result obtained when the ink is ejected from a remainder nozzle left over in the second group grouping process in the example of the second embodiment, FIG. 14D explains a third nozzle group and a judgment result thereof in the example of the second embodiment, FIG. 14E explains a judgment result obtained when the ink is ejected from one nozzle of the third nozzle group in the example of the second embodiment, and FIG. 14F explains judgment results to indicate whether or not each of the nozzles is the ejection-defective nozzle, as obtained from the judgment results depicted in FIGS. 14A to 14E.

DESCRIPTION OF THE PREFERRED EMBODIMENTS

First Embodiment

A first embodiment of the present disclosure will be explained below.

<Overall Configuration of Printer>

Figure 1:
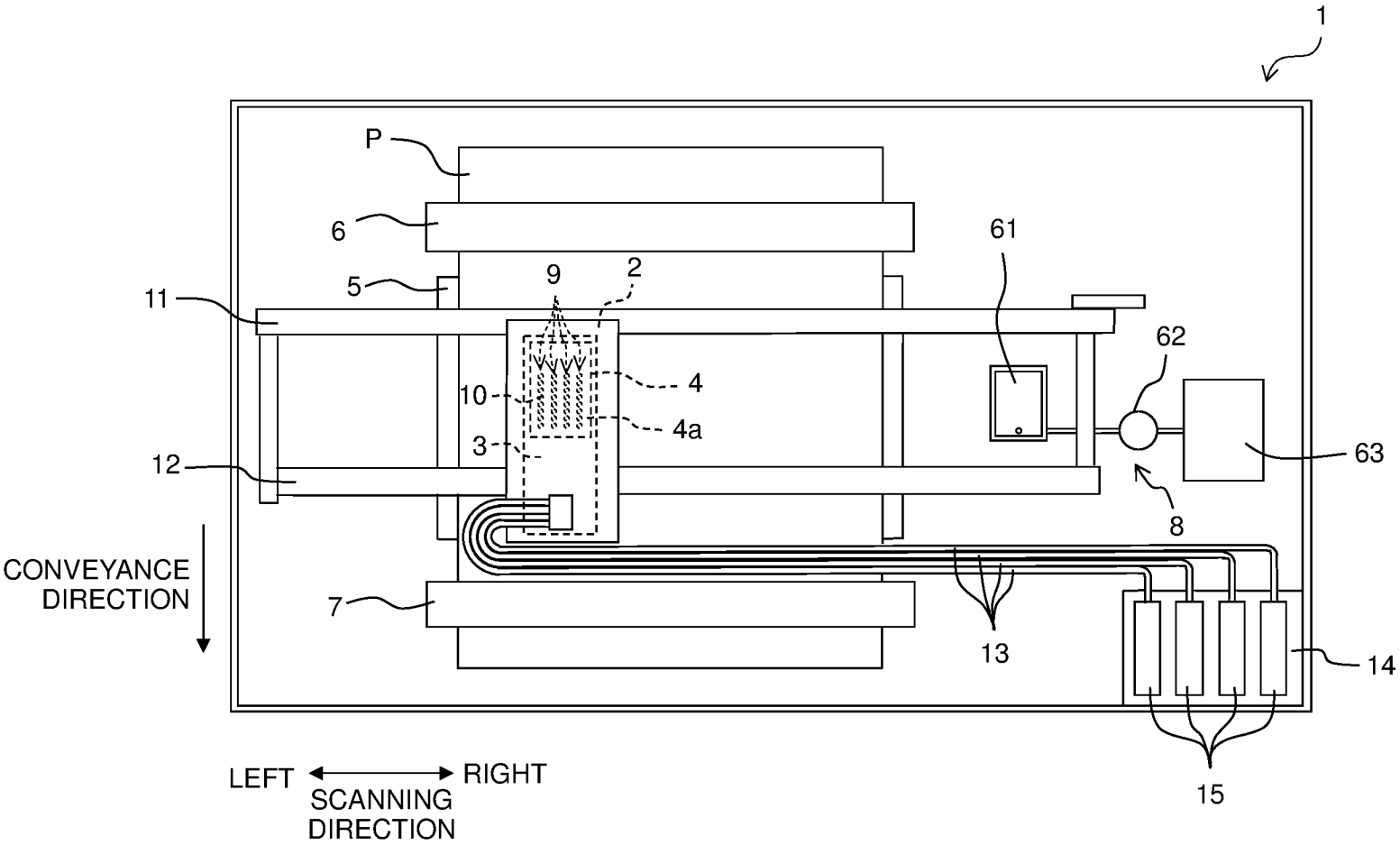
FIG. 1 depicts a schematic arrangement of a printer according to a first embodiment.

As depicted in FIG. 1, a printer 1 according to the first embodiment ("liquid ejection apparatus" of the present disclosure) comprises, for example, a carriage 2, a subtank 3, an ink-jet head 4 ("liquid ejection head" of the present disclosure), a platen 5, conveying rollers 6, 7, and a maintenance unit 8.

The carriage 2 is supported by two guide rails 11, 12 which extend in the scanning direction. The carriage 2 is connected to a carriage motor 86 (see FIG. 6), for example, by the aid of an unillustrated belt. When the carriage motor 86 is driven, the carriage 2 is moved in the scanning direction along the guide rails 11, 12. Note that in the following description, an explanation will be made while defining the right side and the left side in the scanning direction as depicted in FIG. 1.

The subtank 3 is carried on the carriage 2. In this case, the printer 1 is provided with a cartridge holder 14. Four ink cartridges 15 are removably installed to the cartridge holder 14. Black, yellow, cyan, and magenta inks ("liquids" of the present disclosure) are stored in the four ink cartridges 15 as referred to in an order starting from one arranged on the right side in the scanning direction. The subtank 3 is connected to the four ink cartridges 15 installed to the cartridge holder 14 by the aid of four tubes 13. Accordingly, the four color inks are supplied from the four ink cartridges 15 to the subtank 3.

The ink-jet head 4 is carried on the carriage 2, and the ink-jet head 4 is connected to a lower end portion of the subtank 3. The four color inks are supplied from the subtank 3 to the ink-jet head 4. Further, the ink-jet head 4 discharges the inks from a plurality of nozzles 10 which are formed on a nozzle surface 4*a* as the lower surface thereof. This structure will be explained in more detail below. That is, the plurality of nozzles 10 form nozzle arrays 9 by being arranged in the conveyance direction ("one direction" of the present disclosure) orthogonal to the scanning direction. The ink-jet head 4 has four arrays of the nozzle arrays 9 which are aligned in the scanning direction. Black, yellow, cyan, and magenta inks are ejected from the plurality of nozzles 10 as referred to starting from those for constructing the nozzle array 9 disposed on the right side in the scanning direction.

The platen 5 is arranged under or below the ink-jet head 4, and the platen 5 is opposed to the plurality of nozzles 10. The platen 5 extends over the entire length of the recording paper P ("medium" of the present disclosure) in the scanning direction, and the platen 5 supports the recording paper P from the lower position. The conveying roller 6 is arranged on the upstream side in the conveyance direction as compared with the ink-jet head 4 and the platen 5. The conveying roller 7 is arranged on the downstream side in the conveyance direction as compared with the ink-jet head 4 and the platen 5. The conveying rollers 6, 7 are connected to a conveying motor 87 (see FIG. 6), for example, by the aid of unillustrated gears. When the conveying motor 87 is driven, then the conveying rollers 6, 7 are rotated, and the recording paper P is conveyed in the conveyance direction.

The maintenance unit 8 is provided in order that the inks contained in the ink-jet head 4 are ejected from the plurality of nozzles 10 by performing the suction purge as described later on. The maintenance unit 8 will be explained later on.

<Ink-Jet Head>

Figure 2:
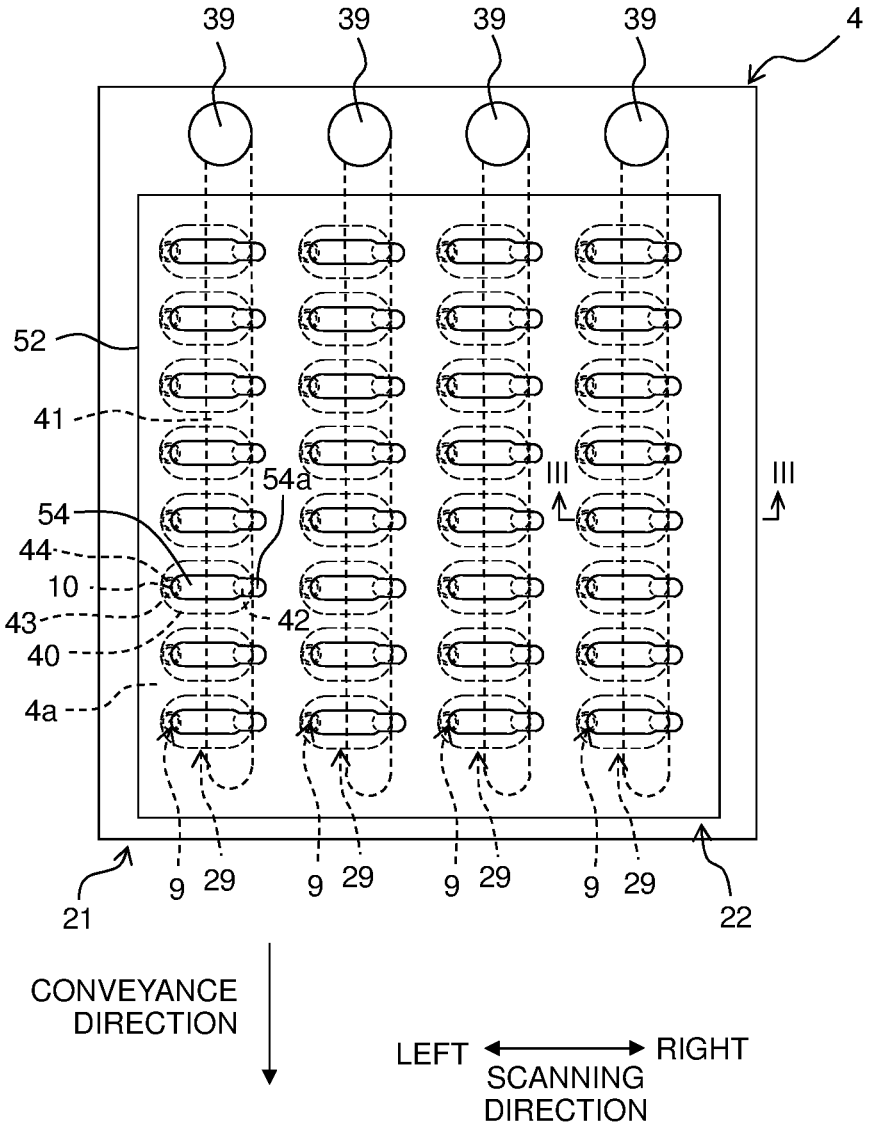
FIG. 2 depicts a plan view illustrating an ink-jet head depicted in FIG. 1.
Figure 3:
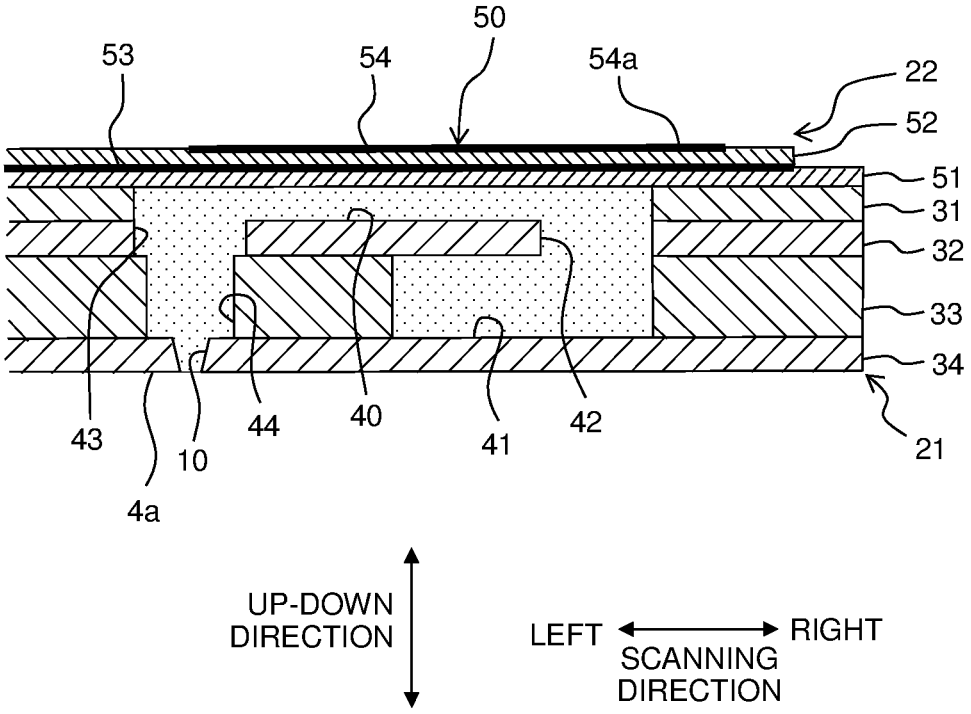
FIG. 3 depicts a sectional view taken along a line III-III depicted in FIG. 2.

Next, the ink-jet head 4 will be explained. As depicted in FIGS. 2 and 3, the ink-jet head 4 is provided with a channel unit 21 and a piezoelectric actuator 22.

<Channel Unit>

The channel unit 21 is formed by stacking four plates 31 to 34 in an order as referred to from the top. Each of the plates 31 to 33 is formed of a metal material such as stainless steel or the like. The plate 34 is formed of a synthetic resin material such as polyimide or the like.

The plate 34 is formed with four nozzle arrays 9 which are disposed adjacently in the scanning direction. Each of the nozzle arrays 9 includes the plurality of nozzles 10 which are arranged in the conveyance direction. The lower surface of the plate 34 serves as the nozzle surface 4*a* of the ink-jet head 4. The plate 31 is formed with four pressure chamber arrays 29 which are disposed adjacently in the scanning direction. Each of the pressure chamber arrays 29 includes a plurality of pressure chambers 40 which are arranged in the conveyance direction. Each of the pressure chambers 40 has an elliptic planar shape in which the scanning direction is the longitudinal direction. Further, the plurality of pressure chambers 40 correspond to the plurality of nozzles 10 respectively. A left end portion in the scanning direction of each of the pressure chambers 40 is overlapped with corresponding one of the nozzles 10 in the upward-downward direction.

The plate 32 is formed with circular through-holes 42 which are provided at portions thereof overlapped in the upward-downward direction with the right end portions in the scanning direction of the plurality of pressure chambers 40 respectively. Further, the plate 32 is formed with circular through-holes 43 which are provided at portions thereof overlapped in the upward-downward direction with the nozzles 10 and the left end portions in the scanning direction of the plurality of pressure chambers 40 respectively.

The plate 33 is formed with four manifold channels 41 ("common channels" of the present disclosure). The four manifold channels 41 correspond to the four pressure chamber arrays 29. The manifold channel 41 extends in the conveyance direction, and the manifold channel 41 is overlapped in the upward-downward direction with the right portions in the scanning direction of the plurality of pressure chambers 40 for constructing the corresponding pressure chamber array 29. Accordingly, each of the pressure chambers 40 is communicated with the manifold channel 41 via the through-hole 42. Further, a supply port 39 is provided at the end portion on the upstream side in the conveyance direction of each of the manifold channels 41. The ink-jet head 4 is connected to channels formed in the subtank 3, at the supply ports 39. Accordingly, the inks are supplied from the supply ports 39 to the manifold channels 41. Further, the plate 33 is formed with circular through-holes 44 which are provided at portions thereof overlapped in the upward-downward direction with the plurality of through-holes 43 and the plurality of nozzles 10 respectively. Accordingly, the respective nozzles 10 are communicated with the corresponding pressure chambers 40 via the through-holes 43, 44.

Then, in the channel unit 21, one individual channel 46 is formed by one nozzle 10, the pressure chamber 40 corresponding to the nozzle 10, and the through-holes 42 to 44.

<Piezoelectric Actuator>

The piezoelectric actuator 22 is provided with a vibration plate 51, a piezoelectric layer 52, a common electrode 53, and a plurality of individual electrodes 54. The vibration plate 51 is formed of a piezoelectric material containing a main component of lead zirconate titanate which is mixed crystal of lead titanate and lead zirconate. The vibration plate 51 is arranged on the upper surface of the channel unit 21 to cover the plurality of pressure chambers 40. Note that the vibration plate 51 may be formed of an insulative material other than the piezoelectric material, unlike the piezoelectric layer 52 explained below.

The piezoelectric layer 52 is formed of the piezoelectric material described above. The piezoelectric layer 52 is arranged on the upper surface of the vibration plate 51, and the piezoelectric layer 52 continuously extends over the plurality of pressure chambers 40. The common electrode 53 is arranged between the vibration plate 51 and the piezoelectric layer 52, and the common electrode 53 continuously extends over the plurality of pressure chambers 40. The common electrode 52 is connected to an unillustrated power source circuit, for example, by the aid of an unillustrated wiring member, and the common electrode 53 is retained at the ground electric potential.

The plurality of individual electrodes 54 correspond to the plurality of pressure chambers 40. The individual electrode 54 has an elliptic planar shape which is one size smaller than the pressure chamber 40. The plurality of individual electrodes 54 are arranged on the upper surface of the piezoelectric layer 52. Each of the individual electrodes 54 is overlapped in the upward-downward direction with a central portion of the corresponding pressure chamber 40. Further, the right end portion of each of the individual electrodes 54 in the scanning direction extends to the right side in the scanning direction until arrival at a position at which the individual electrode 54 is not overlapped in the upward-downward direction with the corresponding pressure chamber 40. The right forward end in the scanning direction of each of the individual electrodes 54 serves as a connecting terminal 54*a*. An unillustrated wiring member is connected to the connecting terminal 54*a*. The individual electrode 54 is connected to driver IC 59 (see FIG. 6) by the aid of the wiring member. Then, the driver IC 59 selectively applies any one of the ground electric potential and a predetermined driving electric potential (for example, about 20 V) individually to the plurality of individual electrodes 54.

Further, each of the portions of the piezoelectric layer 52, which is interposed by the common electrode 53 and each of the individual electrodes 54, is polarized in the thickness direction, corresponding to the common electrode 53 and the plurality of individual electrodes 54 arranged as described above. Then, in the piezoelectric actuator 22 having the structure as described above, each of the portions, which is formed by the individual electrode 54 and the portions of the vibration plate 51, the piezoelectric layer 52, and the common electrode 53 overlapped in the upward-downward direction with each of the pressure chambers 40, forms a driving element 50 for applying the pressure to the ink contained in the pressure chamber 40.

In this case, in each of the driving elements 50 of the piezoelectric actuator 22, when the electric potential of the individual electrode 54 is switched from the ground electric potential to the driving electric potential, the difference in the electric potential arises between the individual electrode 54 and the common electrode 53. Accordingly, the electric field, which is provided in the thickness direction parallel to the polarization direction, is generated at the portion of the piezoelectric layer 52 interposed by the individual electrode 54 and the common electrode 53. The portion of the piezoelectric layer 52 is shrunk in the horizontal direction by the electric field. The portions of the vibration plate 51 and the piezoelectric layer 52, which are overlapped in the upward-downward direction with the pressure chamber 40, are deformed as a whole so that the portions protrude toward the pressure chamber 40. On the other hand, when the electric potential of the individual electrode 54 is switched from the driving electric potential to the ground electric potential, then the individual electrode 54 and the common electrode 53 have the same electric potential, and the portions of the vibration plate 51 and the piezoelectric layer 52, which are overlapped in the upward-downward direction with the pressure chamber 40, return to the state having been provided before the deformation. Then, the volume in the pressure chamber 40 is changed in accordance with the deformation of the portions of the vibration plate 51 and the piezoelectric layer 52 overlapped in the upward-downward direction with the pressure chamber 40 when the electric potential of the individual electrode 54 is switched between the ground electric potential and the driving electric potential. The pressure is applied to the ink contained in the pressure chamber 40, and the ink is ejected from the nozzle 10 communicated with the pressure chamber 40.

<Maintenance Unit>

Next, the maintenance unit 8 will be explained. As depicted in FIG. 1, the maintenance unit 8 is provided with a cap 61, a suction pump 62, and a waste liquid tank 63. The cap 61 is arranged on the right side in the scanning direction as compared with the platen 5. Then, when the carriage 2 is positioned at the maintenance position disposed on the right side in the scanning direction as compared with the platen 5, the plurality of nozzles 10 are opposed to the cap 61.

Figure 6:
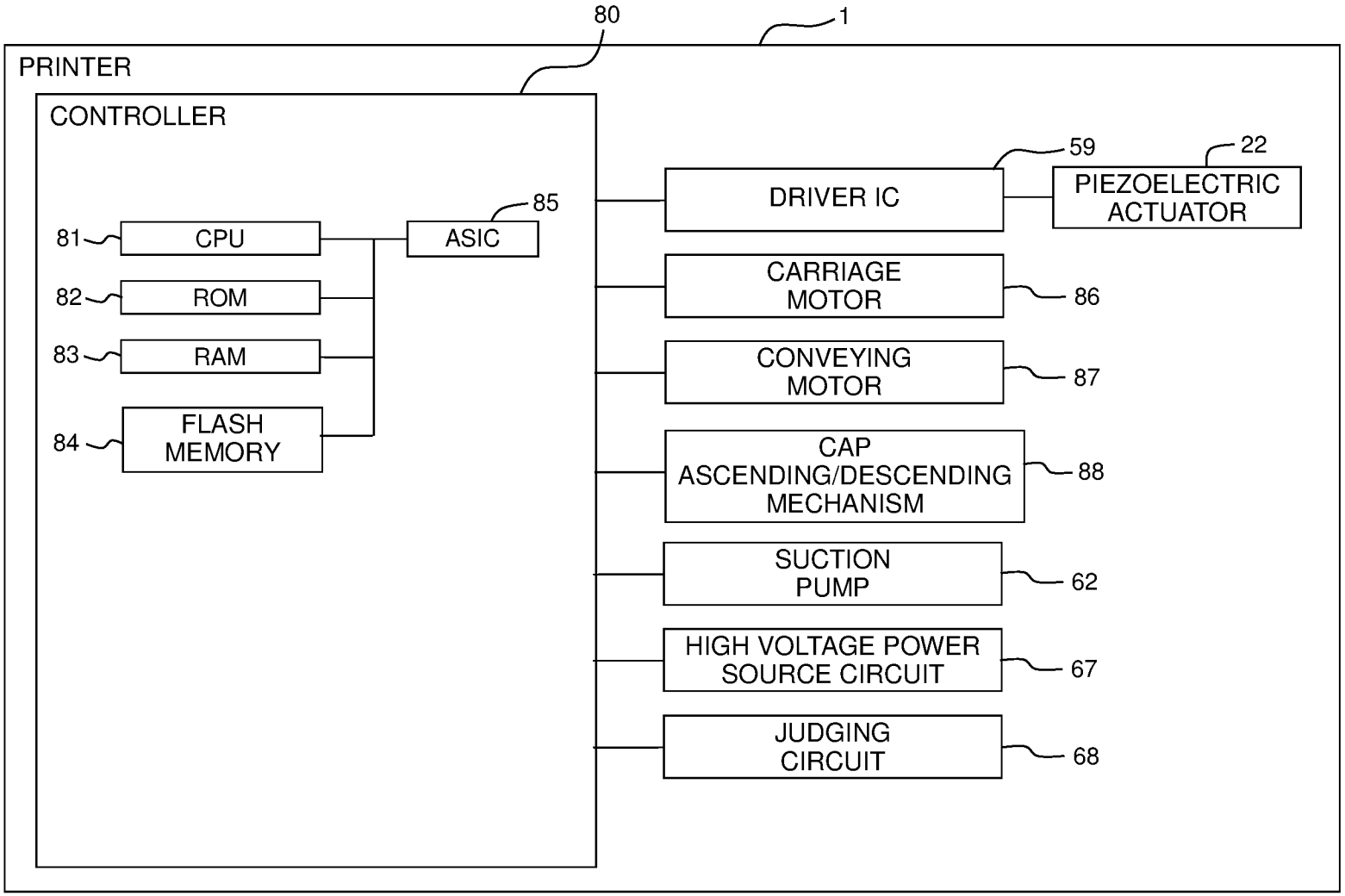
FIG. 6 depicts a block diagram illustrating the electric configuration of the printer.

Further, the cap 61 is capable of ascending/descending by means of a cap ascending/descending mechanism 88 (see FIG. 6). Then, when the cap 61 is moved upwardly by means of the cap ascending/descending mechanism 88 in a state in which the plurality of nozzles 10 are opposed to the cap 61 while positioning the carriage 2 at the maintenance position, the upper end portion of the cap 61 makes tight contact with the nozzle surface 4*a*. Accordingly, the plurality of nozzles 10 are covered with the cap 61. Note that the cap 61 of the present disclosure is not limited to one which covers the plurality of nozzles 10 by making tight contact with the nozzle surface 4*a*. The cap 61 may cover the plurality of nozzles 10, for example, by making tight contact with an unillustrated frame arranged around the nozzle surface 4*a* of the ink-jet head 4.

The suction pump 62 is, for example, a tube pump. The suction pump 62 is connected to the cap 61 and the waste liquid tank 63. Then, in the maintenance unit 8, when the suction pump 62 is driven in the state in which the plurality of nozzles 10 are covered with the cap 61 as described above, it is possible to perform the so-called suction purge in which the inks contained in the ink-jet head 4 are ejected from the plurality of nozzles 10. The inks, which are ejected from the ink-jet head 4, are stored in the waste liquid tank 63. Note that in this embodiment, the maintenance unit 8, which performs the suction purge, corresponds to the "purge unit" of the present disclosure.

Note that in this section, for the purpose of convenience, the explanation has been made assuming that the cap 61 collectively covers all of the nozzles 10, and the inks contained in the ink-jet head 4 are ejected from all of the nozzles 10 in the suction purge. However, the present disclosure is not limited thereto. For example, the cap 61 may be separately provided with a portion which covers the plurality of nozzles 10 for constructing the nozzle array 9 disposed on the rightmost side for ejecting the black ink and a portion which covers the plurality of nozzles 10 for constructing the three arrays of the nozzle arrays 9 disposed on the left side for ejecting the color inks (inks of yellow, cyan, and magenta), wherein any one of the black ink and the color inks contained in the ink-jet head 4 can be selectively ejected in the suction purge.

Figure 4:
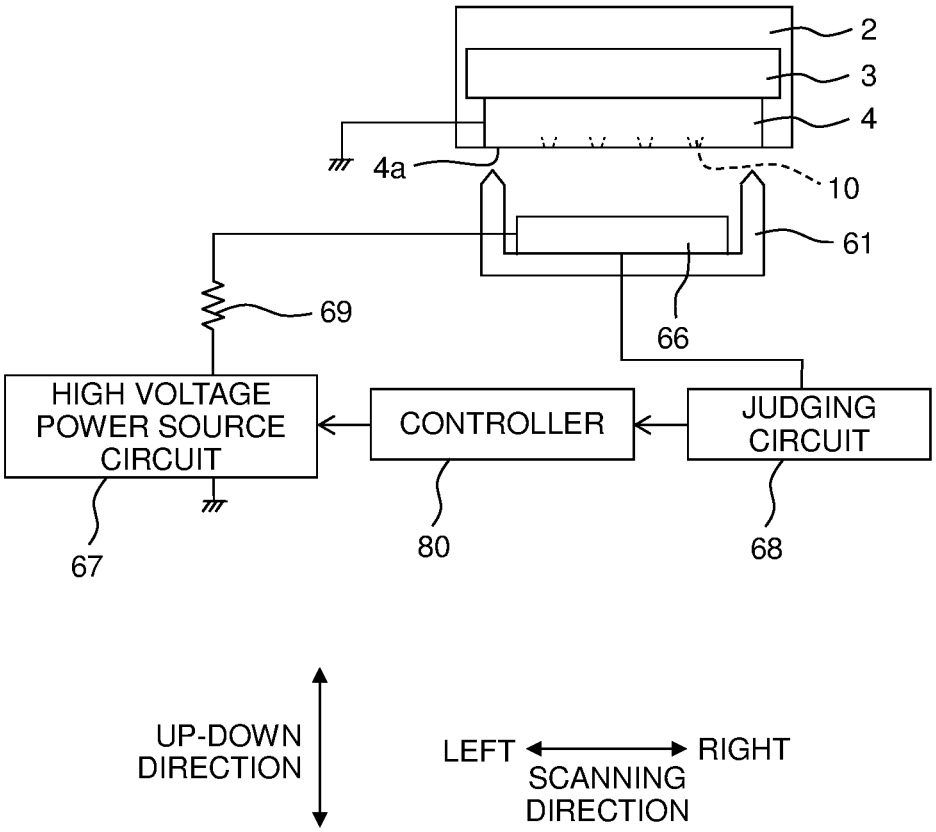
FIG. 4 explains a detecting conducting unit arranged in a cap and a connection relationship among the detecting conducting unit, a high voltage power source circuit, and a judging circuit.

Further, as depicted in FIG. 4, a detecting conducting unit 66 (an example of a detecting conductor), which has a rectangular planar shape, is arranged in the cap 61. The detecting conducting unit 66 is connected to a high voltage power source circuit 67 via a resistor 69. Then, a predetermined positive electric potential (for example, about 300 V) is applied to the detecting conducting unit 66 by the high voltage power source circuit 67. On the other hand, the channel unit 21 of the ink-jet head 4 is retained at the ground electric potential. Accordingly, a predetermined difference in electric potential is generated between the ink-jet head 4 and the detecting conducting unit 66. A judging circuit 68 is connected to the detecting conducting unit 66. The judging circuit 68 outputs a signal in accordance with a maximum voltage value Vm of a signal outputted from the detecting conducting unit 66.

Figure 5A:
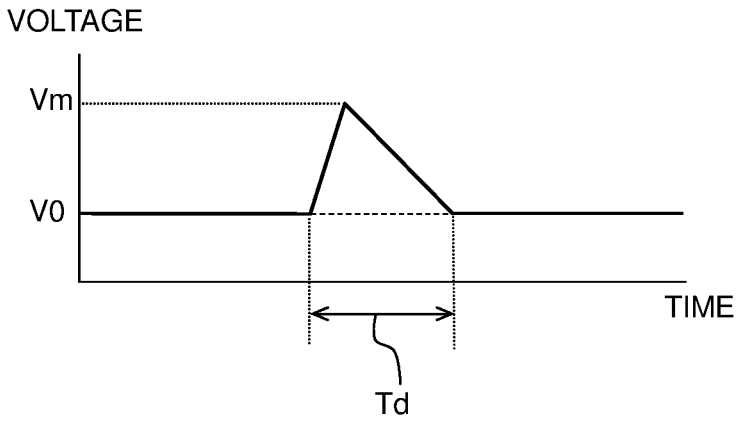
FIG. 5A depicts a signal outputted from the detecting conducting unit when the ink is ejected from the nozzle.

An explanation will be made in more detail below. For example, the voltage value of the detecting conducting unit 66 is V0 in a state in which the ink is not ejected from the nozzle 10. The difference in electric potential is generated between the ink-jet head 4 and the detecting conducting unit 66. Therefore, the ink ejected from the nozzle 10 is charged or electrified. Therefore, when the ink is ejected from the nozzle 10 toward the detecting conducting unit 66 in the state in which the carriage 2 is positioned at the maintenance position, the electrified ink approaches the detecting conducting unit 66. As depicted in FIG. 5A, the voltage value of the detecting conducting unit 66 is raised until the ink is landed on the detecting conducting unit 66. The voltage value arrives at a maximum voltage value Vm which is higher than the voltage value V0. Then, the voltage value of the detecting conducting unit 66 is gradually lowered to the voltage value V0 after the electrified ink is landed on the detecting conducting unit 66. That is, the voltage value of the detecting conducting unit 66 is changed in the driving period Td of the ink-jet head 4. On the other hand, when the ink is not ejected from the nozzle 10, then the voltage value is scarcely changed from V0 as depicted by a broken line in FIG. 5A, and the maximum voltage value Vm is V0 in the driving period Td.

Figure 5B:
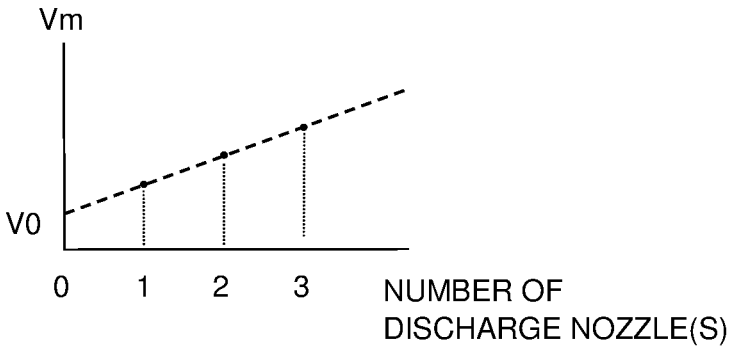
FIG. 5B depicts a relationship between the number of nozzles from which the ink is simultaneously ejected and a maximum voltage value of the signal depicted in FIG. 5A.

Further, as depicted in FIG. 5B, the larger the number of the nozzles 10 from which the ink is simultaneously ejected is, the higher the maximum voltage value Vm is. The judging circuit 68 compares the relationship of magnitude between the maximum voltage value Vm and each of a plurality of threshold values set individually for the number of the nozzles 10 from which the ink is ejected simultaneously. The judging circuit 68 outputs a signal having a voltage value (output value) corresponding to the relationship of magnitude.

According to the fact as described above, the judging circuit 68 outputs the different signals between when the ink is ejected from the nozzle 10 and the maximum voltage value Vm is higher than V0 and when the ink is not ejected from the nozzle 10 and the maximum voltage value Vm is V0. Further, when the ink is ejected from two or more nozzles 10, the judging circuit 68 outputs a signal having a voltage value which is proportional to the number of nozzles from which the ink is actually ejected. In this situation, the number of ejection-defective nozzles from which the ink is not ejected is obtained by subtracting the number of the nozzles 10 from which the ink is actually ejected from the number of the nozzles 10 from which the ink is simultaneously ejected. The number of ejection-defective nozzles from which the ink is not ejected corresponds one-to-one to the number of the nozzles 10 from which the ink is ejected. Therefore, it is affirmed that the signal, which is outputted from the judging circuit 68, is the signal which has the voltage value that differs in proportion to the number of ejection-defective nozzles. Note that in the first embodiment, the combination of the detecting conducting unit 66, the high voltage power source circuit 67, the resistor 69, and the judging circuit 68 corresponds to the "signal output circuit" of the present disclosure.

Further, in this case, the positive electric potential is applied to the detecting conducting unit 66 by the high voltage power source circuit 67. However, any negative electric potential (for example, about −300 V) may be applied to the detecting conducting unit 66 by the high voltage power source circuit 67. In this case, conversely to the above, when the ink is ejected from the nozzle 10 toward the detecting conducting unit 66 in a state in which the carriage 2 is positioned at the maintenance position, then the electrified ink approaches the detecting conducting unit 66, and the voltage value of the detecting conducting unit 66 is lowered until the ink is landed on the detecting conducting unit 66.

<Electric Configuration of Printer>

Next, the electric configuration of the printer 1 will be explained. The operation of the printer 1 is controlled by the controller 80. As depicted in FIG. 6, the controller 80 has, for example, CPU (Central Processing Unit) 81, ROM (Read Only Memory) 82, RAM (Random Access Memory) 83, a flash memory 84, and ASIC (Application Specific Integrated Circuit) 85. The controller 80 controls the operations of, for example, the carriage motor 86, the conveying motor 87, the cap ascending/descending mechanism 88, the high voltage power source circuit 67, and the suction pump 62. Further, the controller 80 controls the ink-jet head 4 by controlling the driver IC 59. Further, the signal as described above is inputted from the judging circuit 68 into the controller 80.

Note that as for the controller 80, only CPU 81 may perform the various processes, only ASIC 85 may perform the various processes, or CPU 81 and ASIC 85 may cooperate to perform the various processes. Further, as for the controller 80, one CPU 81 may perform the processes singly, or a plurality of CPU's 81 may perform the processes in a shared manner. Further, as for the controller 80, one ASIC 85 may perform the processes singly, or a plurality of ASIC's 85 may perform the processes in a shared manner.

<Process of Judgment of Ejection-Defective Nozzle or the Like>

Next, an explanation will be made about the flow of the process when it is judged in the printer 1, for example, whether or not each of the plurality of nozzles 10 of the ink-jet head 4 is the ejection-defective nozzle. In the printer 1, it is judged, for example, whether or not the nozzle is the ejection-defective nozzle at a timing (for example, a regular or periodic timing) at which the recording is not performed on the recording paper P and a timing which is provided immediately before the recording on the recording paper P.

Figure 7:
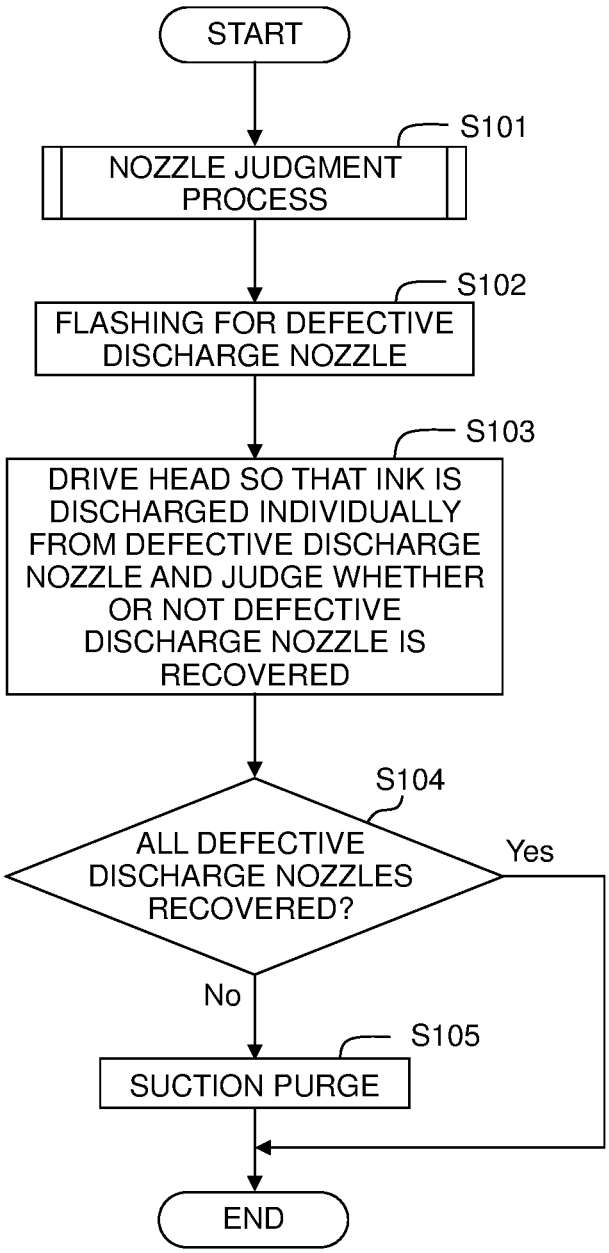
FIG. 7 depicts a flow chart illustrating a flow of the process when the viscosity of the ink contained in the nozzle is estimated at a timing other than a timing provided immediately before the recording on the recording paper.

At the timing at which the recording is not performed on the recording paper P, it is judged, for example, whether or not the nozzle is the ejection-defective nozzle by performing the process in accordance with the flow depicted in FIG. 7. An explanation will be made in more detail below. At first, the controller 80 executes a nozzle judgment process (S101) to judge whether or not each of the plurality of nozzles 10 of the ink-jet head 4 is the ejection-defective nozzle. The nozzle judgment process will be explained later on.

Subsequently, the controller 80 drives the ink-jet head 4 on the basis of the result of the nozzle judgment process of S101 to perform the flashing for discharging the ink from the ejection-defective nozzle (S102). Subsequently, the controller 80 drives the ink-jet head 4 so that the ink is individually discharged toward the detecting conducting unit 66 from each of the ejection-defective nozzles. It is judged whether or not the ejection-defective nozzle is recovered on the basis of the signal outputted from the judging circuit 68 in this situation (S103).

Then, if all of the ejection-defective nozzles are recovered (S104: YES), the process is terminated as it is. If any unrecovered ejection-defective nozzle is present (S104: NO), then the controller 80 controls, for example, the carriage motor 86, the cap ascending/descending mechanism 88, and the suction pump 62 to perform the suction purge (S105), and then the process is terminated.

<Nozzle Judgment Process>

Figure 8A:
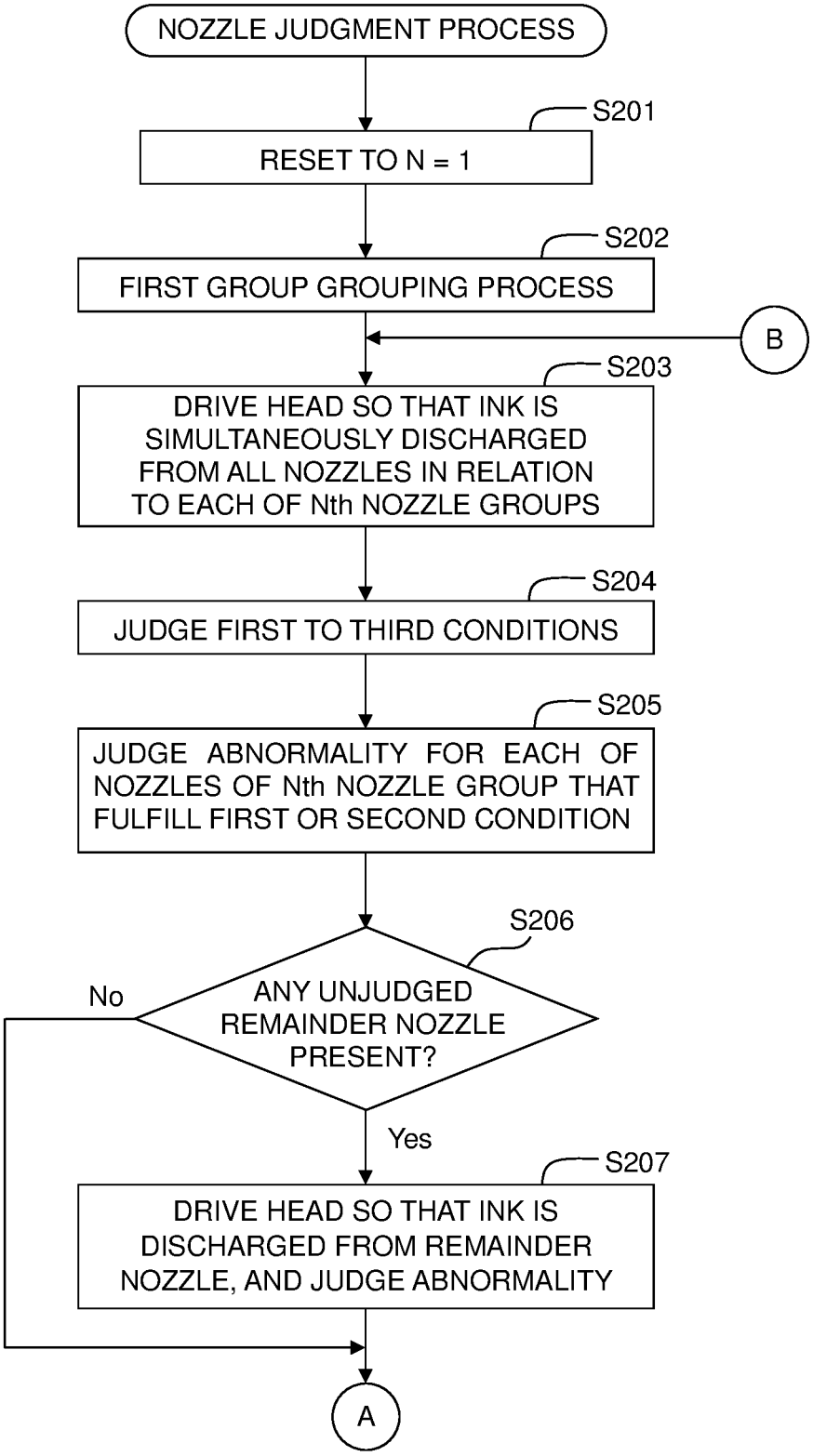
FIGS. 8A and 8B depict flow charts illustrating a flow of the nozzle judging process depicted in FIG. 7.

Next, the nozzle judgment process of S101 will be explained in detail. In the nozzle judgment process, as depicted in FIG. 8A, the controller 80 firstly resets a natural number variable N to 1 (S201). The first group grouping process is executed (S202), and the routine proceeds to the process of S203. In the first group grouping process of S202, the controller 80 classifies the plurality of nozzles 10 of the ink-jet head 4 into a plurality of first nozzle groups each of which is composed of two or more nozzles 10. In this procedure, the two or more nozzles 10, which constitute each of the first nozzle groups, are selected and set from the plurality of nozzles 10 of the ink-jet head 4 so that the two or more nozzles 10, which constitute each of the first nozzle groups, are the nozzles 10 which form the same nozzle array 9 and which are aligned adjacently in the conveyance direction.

In S203, the controller 80 drives the ink-jet head 4 so that the ink is simultaneously ejected from all of the two or more nozzles 10 for constructing the Nth nozzle group in relation to each of the plurality of Nth nozzle groups. In this procedure, the operation, in which the ink-jet head 4 is driven so that the ink is simultaneously ejected from all of the two or more nozzles 10 for constructing the Nth nozzle group, resides in such an operation that the driving elements 50, which correspond to the two or more nozzles 10 for constructing the Nth nozzle group, are driven at the same timing.

Then, the controller 80 judges which condition of the first to third conditions is satisfied in relation to each of the plurality of Nth nozzle groups on the basis of the signal outputted from the judging circuit 68 in this situation (S204). The first condition is such a condition that any ejection-defective nozzle is absent in the two or more nozzles 10 for constructing the Nth nozzle group. The second condition is such a condition that all of the two or more nozzles 10 for constructing the Nth nozzle group are the ejection-defective nozzles. The third condition is such a condition that only some nozzles 10 of the two or more nozzles 10 for constructing the Nth nozzle group are the ejection-defective nozzles.

Subsequently, the controller 80 judges that the nozzles 10, which constitute the Nth nozzle group that satisfies the first condition, are not the ejection-defective nozzles, and the controller 80 judges that the nozzles 10, which constitute the Nth nozzle group that satisfies the second condition, are the ejection-defective nozzles (S205).

Subsequently, the controller 80 judges whether or not remainder nozzles are present (S206), for which it has not been judged whether or not the remainder nozzles are the ejection-defective nozzles, the remainder nozzles being not classified into any nozzle group in the first group grouping process of S202 or the Nth group grouping process of S215 described later on. For example, if the number of the nozzles 10 which are the objects of the classification into the Nth nozzle group is indivisible by the number of the nozzles 10 for constructing each of the Nth nozzle groups, the remainder nozzles 10 are present. Then, if the remainder nozzles 10 are present (S206: YES), the ink-jet head 4 is driven so that the ink is ejected from each of the remainder nozzles 10. It is judged whether or not each of the remainder nozzles 10 is the ejection-defective nozzle on the basis of the signal outputted from the judging circuit 68 in this situation (S207), and the routine proceeds to S208. If the remainder nozzles 10 are not present (S206: NO), the routine proceeds to S208 as it is.

In S208, it is judged whether or not all of the Nth nozzle groups satisfy the first condition or the second condition. Then, if all of the Nth nozzle groups satisfy the first condition or the second condition (S208: YES), the routine returns to the flow depicted in FIG. 7.

If only one Nth nozzle group, which satisfies the third condition, is present (S208: NO, S209: YES), the ink-jet head 4 is driven so that the ink is individually ejected from each of the remaining nozzles 10 obtained by excluding one nozzle 10 from the two or more nozzles 10 for constructing one Nth nozzle group which satisfies the third condition (S210). Then, it is judged whether or not each of the two or more nozzles 10 for constructing one Nth nozzle group is the ejection-defective nozzle on the basis of the signal which is outputted from the judging circuit 68 in this situation and the signal which is outputted from the judging circuit 68 when the ink is simultaneously ejected from the two or more nozzles 10 in S203 in relation to the one Nth nozzle group (S211). The routine returns to the flow depicted in FIG. 7.

Specifically, in S211, it is judged whether or not each of the remaining nozzles 10 is the ejection-defective nozzle on the basis of the signal outputted from the judging circuit 68. Further, it is judged whether or not the one nozzle 10, which is excluded from the Nth nozzle group as described above, is the ejection-defective nozzle on the basis of the result of the above and the number of ejection-defective nozzles obtained from the value of the signal outputted from the judging circuit 68 when the ink-jet head 4 is driven in S203 in relation to the one Nth nozzle group.

Then, if the variable N is 1 (S212: YES), the routine returns to the flow depicted in FIG. 7. If the variable N is not less than 2 (S212: NO), the controller 80 successively judges whether or not the respective nozzles 10 of the first to [N−1]th nozzle groups, which satisfy the third condition, are the ejection-defective nozzles on the basis of the judgment result obtained in the process of S211 and the number of ejection-defective nozzles obtained from the signal outputted from the judging circuit 68 when the ink is simultaneously ejected from the two or more nozzles in S203 in relation to each of the first to [N−1]th nozzle groups which satisfy the third condition (S213).

On the other hand, if a plurality of the Nth nozzle groups, which satisfy the third condition, are present (S208: NO, S209: NO), then the controller 80 increases the variable N by 1 (S214), and the Nth group grouping process is executed (S215).

Figure 9:
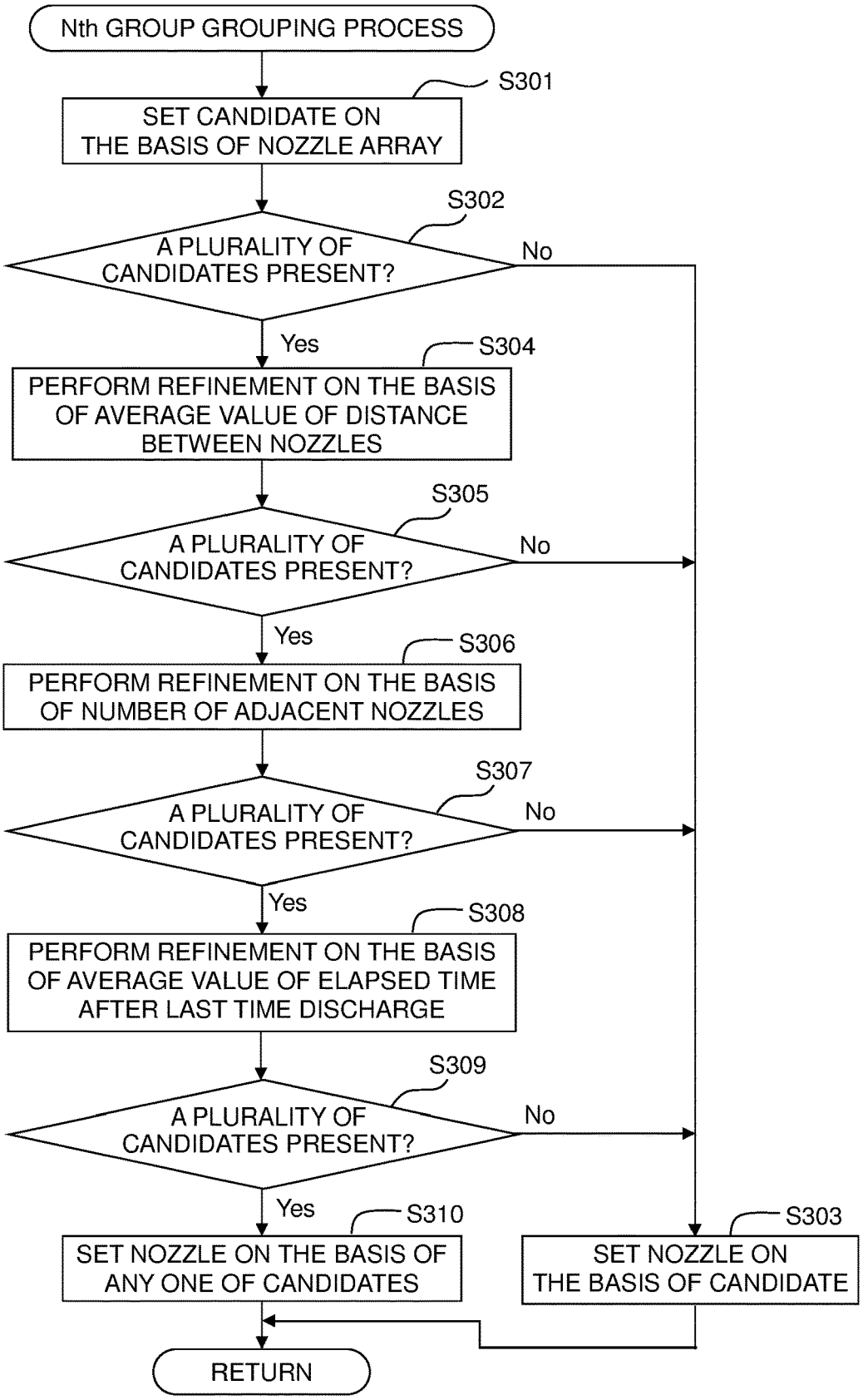
FIG. 9 depicts a flow chart illustrating a flow of the Nth group grouping process depicted in FIG. 8B.

In the Nth group grouping process of S215, the controller 80 classifies the remaining nozzles 10 obtained by excluding one nozzle 10 from each of the plurality of [N−1]th nozzle groups which satisfy the third condition, into one or a plurality of Nth nozzle group or nozzle groups each of which is composed of two or more nozzles 10 and each of which has the combination of the nozzles 10 different from those of the first to [N−1]th nozzle groups. In this procedure, the controller 80 sets the combination of the nozzles 10 in each of the Nth nozzle groups in accordance with a flow depicted in FIG. 9.

This procedure will be explained in detail. At first, the controller 80 sets the candidate for the nozzle 10 for constructing each of the Nth nozzle groups on the basis of the nozzle array 9 to which the nozzle 10 belongs (color of the ink to be ejected, i.e., manifold channel 41 to be communicated) (S301). Specifically, the candidate for the combination of the nozzles 10 for constructing the Nth nozzle group is set so that the number of the Nth nozzle groups constructed by the two or more nozzles 10 for constructing the same nozzle array 9 is maximized.

Figure 8B:
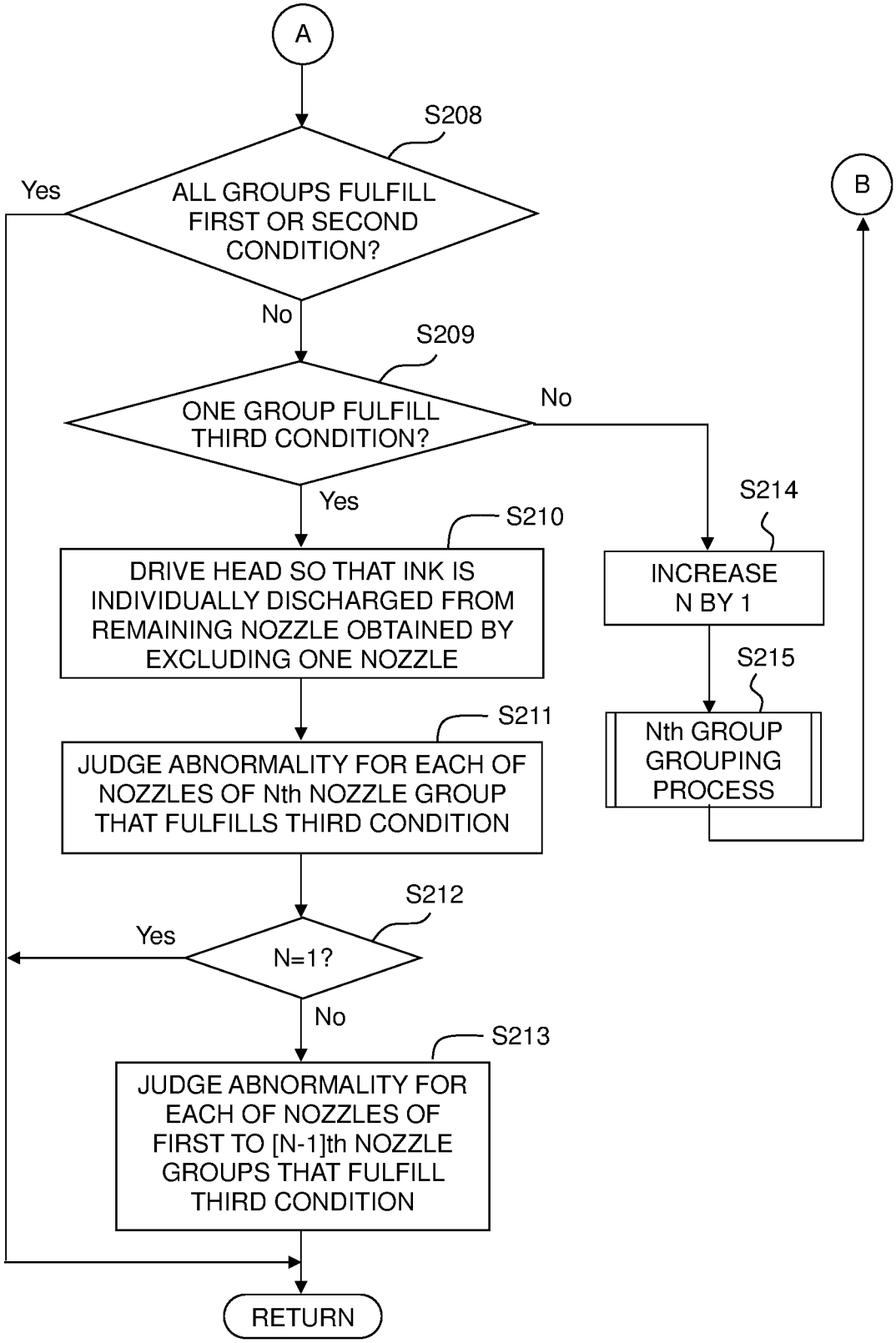

Subsequently, if only one candidate as described above is set in the process of S301 (S302: NO), the controller 80 sets the combination of the nozzles 10 for constructing the Nth nozzle group on the basis of the one candidate (S303). The routine returns to the flow depicted in FIGS. 8A and 8B.

If a plurality of candidates as described above, which are set in the process of S301, are present (S302: YES), the plurality of candidates are refined on the basis of the distance between the nozzles 10 in each of the Nth nozzle groups (S304). Specifically, the candidates are refined to minimize the average value of the distance between the nozzles 10 in each of the Nth nozzle groups, from the plurality of candidates set in the process of S301.

If only one candidate as described above is present after the refinement in the process of S304 (S305: NO), the combination of the nozzles 10 for constructing the Nth nozzle group is set on the basis of the one candidate (S303). The routine returns to the flow depicted in FIGS. 8A and 8B.

If a plurality of candidates as described above are present after the refinement in the process of S304 (S305: YES), the plurality of candidates are refined on the basis of the number of the nozzles 10 which are adjacent in the conveyance direction in the Nth nozzle group (S306). Specifically, the candidates are refined to maximize the number of the Nth nozzle groups constructed by the nozzles 10 which are adjacent in the conveyance direction, from the plurality of candidates after the refinement in the process of S304.

If only one candidate as described above is present after the refinement in the process of S306 (S307: NO), the combination of the nozzles 10 for constructing the Nth nozzle group is set on the basis of the one candidate (S303). The routine returns to the flow depicted in FIGS. 8A and 8B.

If a plurality of candidates as described above are present after the refinement in the process of S306 (S307: YES), the plurality of candidates are refined on the basis of the elapsed time after the last time discharge (S308). Specifically, the candidate is refined to minimize the average value of the difference in the elapsed time after the point in time at which the ink was ejected last time, in relation to the two or more nozzles 10 for constructing the Nth nozzle group, from the plurality of candidates after the refinement in the process of S306.

If only one candidate as described above is present after the refinement in the process of S308 (S309: NO), the combination of the nozzles 10 for constructing the Nth nozzle group is set on the basis of the one candidate (S303). The routine returns to the flow depicted in FIGS. 8A and 8B.

If a plurality of candidates as described above are present after the refinement in the process of S308 (S309: YES), the combination of the nozzles 10 for constructing the Nth nozzle group is set on the basis of any candidate of the plurality of candidates (S310). The routine returns to the flow depicted in FIGS. 8A and 8B.

With reference to FIGS. 8A and 8B again, the controller 80 returns to the process of S203 after the Nth group grouping process in S215. Accordingly, the Nth group grouping process is executed (S215), and the processes of S203 to S207 are repeated until all of the Nth nozzle groups satisfy the first condition or the second condition, or only one Nth nozzle group, which satisfies the third condition, is present. Then, if all of the Nth nozzle groups satisfy the first condition or the second condition (S208: YES), the routine returns to the flow depicted in FIG. 7 as described above. Further, if only one Nth nozzle group, which satisfies the third condition, is present (S209: YES), the routine returns to the flow depicted in FIG. 7 after executing the processes of S210 to S213 as described above. Then, it is judged whether or not each of the plurality of nozzles 10 of the ink-jet head 4 is the ejection-defective nozzle in accordance with the nozzle judgment process explained above.

<Judgment to Judge Whether or not Nozzle is Ejection-Defective Nozzle by Nozzle Judgment Process>

Next, an explanation will be made while referring to specified examples about the judgment to judge whether or not each of the plurality of nozzles 10 of the ink-jet head 4 is the ejection-defective nozzle in accordance with the nozzle judgment process described above.

At first, an example will be explained with reference to FIGS. 10A to 10E about a case in which the number of the nozzles 10 for constructing the Nth nozzle group is two. In this case, the number of the nozzles 10 of the ink-jet head 4 is actually, for example, about several hundreds. However, in order to simplify the explanation, in the example depicted in FIGS. 10A to 10E, it is assumed that the number of the nozzles 10 of the ink-jet head 4 is 18. n1 to n18 depicted in FIGS. 10A to 10E correspond to eighteen nozzles 10.

In the nozzle judgment process, in the first group grouping process of S202, as depicted in FIG. 10A, the eighteen nozzles n1 to n18 are classified into nine first nozzle groups G11 to G19 each of which is composed of two nozzles 10.

Then, as depicted in FIG. 10A, it is judged that the nozzles n1, n2, n13, n14, which constitute the first nozzle groups G11, G17 that satisfy the first condition, are not the ejection-defective nozzles, and it is judged that the nozzles 10 of n5, n6, which constitute the first nozzle group G13 that satisfies the second condition, are the ejection-defective nozzles (S205). In this case, in the judgment result depicted in FIG. 10A, "O" indicates that the first condition is satisfied. "X" indicates that the second condition is satisfied, and "Δ" indicates that the third condition is satisfied.

Further, according to the result depicted in FIG. 10A, the six first nozzle groups G12, G14 to G16, G18, G19 satisfy the third condition (S209: NO). Therefore, in accordance with the second group grouping process (S215), for example, as depicted in FIG. 10B, the remaining nozzles 10 of n3, n7, n9, n11, n15, n17, which are obtained by excluding one nozzle 10 from each of the first nozzle groups G12, G14 to G16, G18, G19 that satisfy the third condition, are classified into three second nozzle groups G21 to G23 each of which is composed of two nozzles 10. Then, it is judged that the nozzles n3, n7, which constitute the second nozzle group G21 that satisfies the first condition, are not the ejection-defective nozzles.

Further, the two second nozzle groups G22, G23 satisfy the third condition (S209: NO). Therefore, in accordance with the third groove grouping process (S215), for example, as depicted in FIG. 10C, the third nozzle group G31 is formed by the nozzles 10 of n9, n15 which are obtained by excluding one nozzle 10 from each of the second nozzle groups G22, G23 that satisfy the third condition. In this case, only one third nozzle group G31 satisfies the third condition (S209: YES). Therefore, for example, as depicted in FIG. 10D, the ink-jet head 4 is driven so that the ink is ejected from the nozzle 10 of n9 which is one of the two nozzles 10 of n9, n15 for constructing the third nozzle group G31 (S210). Then, according to this result, it is judged that the nozzle 10 of n9 is the ejection-defective nozzle. In this case, "abnormal" of the judgment result depicted in FIG. 10D indicates that the nozzle is the ejection-defective nozzle. Further, according to this result and the result depicted in FIG. 10C, it is judged that the nozzle 10 of n15 is not the ejection-defective nozzle.

Then, in the following procedure, the remaining nozzles 10, for which it has not been judged whether or not the nozzles 10 are the ejection-defective nozzles, are successively judged whether or not the nozzles 10 are the ejection-defective nozzles, in accordance with the information of the nozzles 10 for which it has been judged whether or not the nozzles 10 are the ejection-defective nozzles and the results depicted in FIGS. 10A to 10C. Accordingly, as depicted in FIG. 10E, it is possible to judge whether or not the nozzles 10 of n1 to n18 are the ejection-defective nozzles. Note that in FIG. 10E, "normal" indicates that the nozzle is not the ejection-defective nozzle, and "defective discharge" indicates that the nozzle is the ejection-defective nozzle.

Next, an example will be explained with reference to FIGS. 11A to 11F about a case in which the number of the nozzles 10 for constructing the Nth nozzle group is three.

In this example, in the first nozzle group grouping process of S202, as depicted in FIG. 11A, the eighteen nozzles n1 to n18 are classified into six first nozzle groups G11 to G16 each of which is composed of three nozzles 10.

Then, it is judged that the nozzles 10 of n1 to n3, n16 to n18, which constitute the first nozzle groups G11, G16 that satisfy the first condition, are not the ejection-defective nozzles, and it is judged that the nozzles 10 of n7 to n9, which constitute the first nozzle group G13 that satisfies the second condition, are the ejection-defective nozzles (S205). Further, in this procedure, according to the result of the process of S203, the numbers of the ejection-defective nozzles are acquired for the respective nozzles of the first nozzle groups G12, G14, G15 which satisfy the third condition. In this case, parenthesized numerical values described in the judgment result depicted in FIG. 11A indicate the numbers of the ejection-defective nozzles.

Further, in this example, the three first nozzle groups G12, G14, G15 satisfy the third condition. Therefore, in accordance with the second group grouping process (S215), for example, as depicted in FIG. 11B, the remaining nozzles 10 of n4, n5, n10, n11, n13, n14, which are obtained by excluding one nozzle 10 from each of the first nozzle groups G12, G14, G15 that satisfy the third condition, are classified into two second nozzle groups G21, G22 each of which is composed of three nozzles 10. Then, it is judged that the second nozzle groups G21. G22 satisfy the third condition, and the results are acquired such that the numbers of the ejection-defective nozzles in the second nozzle groups G21, G22 are one and two respectively.

Then, the two second nozzle groups G21, G22 satisfy the third condition. Therefore, in accordance with the third group grouping process (S215), for example, as depicted in FIG. 11C, the third nozzle group G31 is formed by the three nozzles 10 of n5, n10, n14 of the nozzles 10 of n5, n10, n13, n14 which are obtained by excluding one nozzle from each of the two second nozzle groups G21, G22. Then, it is judged that the third nozzle group G31 satisfies the third condition, and the result is acquired such that the number of the ejection-defective nozzle is one in the third nozzle group G31. Further, as depicted in FIG. 11D, the ink-jet head 4 is driven so that the ink is ejected from the nozzle 10 of n13 (remainder nozzle) which is left over in the third group grouping process. It is judged that the nozzle is not the ejection-defective nozzle on the basis of the signal outputted from the judging circuit 68 (S207).

Then, only one third nozzle group G31 satisfies the third condition. Therefore, as depicted in FIG. 11E, the ink-jet head 4 is driven so that the ink is individually ejected from each of the remaining nozzles 10 of n5, n10 obtained by excluding one nozzle 10 from the three nozzles 10 of n5, n10, n14 for constructing the third nozzle group G31. Then, it is judged that each of the nozzles 10 of n5, n10 is not the ejection-defective nozzle on the basis of the signal outputted from the judging circuit 68 in this procedure. Further, it is judged that the nozzle 10 of n14 is the ejection-defective nozzle according to this result and the result depicted in FIG. 11C.

Then, in the following procedure, the remaining nozzles 10, for which it has not been judged whether or not the nozzles 10 are the ejection-defective nozzles, are successively judged whether or not the nozzles 10 are the ejection-defective nozzles, in accordance with the information of the nozzles 10 for which it has been judged whether or not the nozzles 10 are the ejection-defective nozzles and the results depicted in FIGS. 11A to 11D. Accordingly, as depicted in FIG. 11F, it is possible to judge whether or not the nozzles 10 of n1 to n18 are the ejection-defective nozzles.

<Control During Recording>

Figure 12:
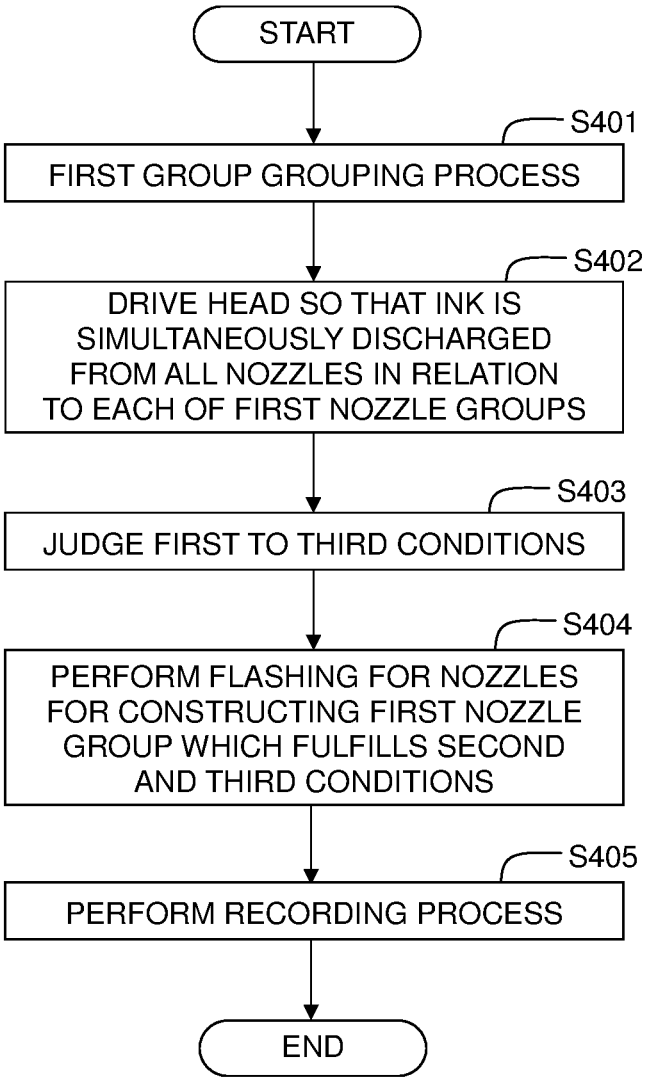
FIG. 12 depicts a flow chart illustrating a flow of the process when a recording instruction is inputted.

Further, in the printer 1, when the recording instruction to instruct the recording of the image on the recording paper P is inputted, the controller 80 performs the process in accordance with the flow depicted in FIG. 12.

This process will be explained in detail below. That is, the controller 80 executes the first group grouping process in the same manner as S202 (S401). Subsequently, the controller 80 drives the ink-jet head 4 so that the ink is simultaneously ejected from all of the two or more nozzles 10 for constructing the first nozzle group in relation to each of the plurality of first nozzle groups (S402). Then, the controller 80 judges which condition of the first to third conditions is satisfied by each of the plurality of first nozzle groups in the same manner as S204 on the basis of the signal outputted from the judging circuit 68 (S403).

Subsequently, the controller 80 drives the ink-jet head 4 on the basis of the result of the judgment in S403, and the flashing is performed to discharge the ink from the two or more nozzles 10 for constructing the first nozzle group which satisfies the second condition and the first nozzle group which satisfies the third condition (S404). Then, after the flashing in S404, the recording process is executed (S405). In the recording process of S405, the controller 80 performs the recording of the image on the recording paper P by alternately performing the recording pass in which the ink-jet head 4 is controlled to eject the ink from the plurality of nozzles 10 while moving the carriage 2 in the scanning direction by controlling the carriage motor 86 and the conveying operation in which the conveying motor 87 is controlled so that the recording paper P is conveyed by a predetermined distance by means of the conveying rollers 6, 7.

Note that in this case, for example, in the example depicted in FIG. 10A, the ink is discharged from the nozzles 10 of n3 to n12, n15 to n18 for constructing the first nozzle groups G12 to G16, G18, G19 in the flashing of S404. As a result, the ink is also discharged from the nozzles 10 of n3, n7, n10, n11, n15, n18 which are not the ejection-defective nozzles. Further, in the example depicted in FIG. 11A, the ink is discharged from the nozzles 10 of n3 to n12, n4 to n15 for constructing the first nozzle groups G12 to G15 in the flashing of S404. As a result, the ink is also discharged from the nozzles 10 of n5, n10, n12, n13 which are not the ejection-defective nozzles.

<Effect of Embodiment>

In the first embodiment, the plurality of nozzles 10 of the ink-jet head 4 are classified into the plurality of first nozzle groups each of which is composed of the two or more nozzles 10. Then, the ink-jet head 4 is driven so that the ink is simultaneously ejected from the two or more nozzles in relation to each of the plurality of first nozzle groups. It is judged which condition of the first to third conditions is satisfied by each of the plurality of first nozzle groups on the basis of the signal outputted from the judging circuit 68 in this situation.

Then, the following operation is repeated until all of the Nth nozzle groups satisfy the first condition or the second condition, or only one Nth nozzle group satisfies the third condition. That is, the nozzles, which are obtained by excluding one of the two or more nozzles in relation to each of the plurality of [N−1]th nozzle groups which satisfy the third condition, are classified into the Nth nozzle groups while changing the combination of the nozzles 10 as compared with the first to [N−1]th nozzle groups, and it is judged which condition of the first to third conditions is satisfied by each of the Nth nozzle groups.

It is understood that all of the nozzles for constructing the Nth nozzle group which satisfies the first condition are not the ejection-defective nozzles. Further, it is understood that all of the nozzles for constructing the Nth nozzle group which satisfies the second condition are the ejection-defective nozzles. Then, as for the Nth nozzle group which satisfies the first condition or the second condition, it is possible to decrease the number of times of the driving the ink-jet head 4 required to judge whether or not the nozzles are the ejection-defective nozzles, as compared with a case in which it is judged whether or not the nozzles are the ejection-defective nozzles by driving the ink-jet head 4 so that the liquid is individually ejected from each of the nozzles 10.

Further, if only one Nth nozzle group, which satisfies the third condition, is present, the ink-jet head 4 is driven so that the ink is individually ejected from the remaining nozzles 10 obtained by excluding one nozzle 10 from the one Nth nozzle group. Accordingly, it is possible to judge whether or not each of the two or more nozzles 10 for constructing the one Nth nozzle group is the ejection-defective nozzle, on the basis of signal (signal corresponding to the number of the ejection-defective nozzles) outputted from the judging circuit 68 when the ink-jet head 4 is driven so that the ink is simultaneously ejected from the two or more nozzles 10 for constructing the one Nth nozzle group and the signal (signal to determine whether or not each of the remaining nozzles 10 is the ejection-defective nozzle) outputted from the judging circuit 68 when the ink-jet head 4 is driven so that the ink is individually ejected from the remaining nozzles 10 of the one Nth nozzle group.

Further, it is possible to judge whether or not each of the nozzles 10 for constructing the first to [N−1]th nozzle groups which satisfy the third condition is the ejection-defective nozzle, on the basis of the result obtained as described above and the signal outputted from the judging circuit 68 when the ink is simultaneously ejected from the two or more nozzles 10 for constructing the nozzle group, in relation to each of the first to [N−1]th nozzle groups which satisfy the third condition.

Then, according to the fact as described above, it is possible to maximally decrease the number of times of the driving of the ink-jet head 4 required to judge whether or not each of the plurality of nozzles 10 of the ink-jet head 4 is the ejection-defective nozzle. In the case of the first embodiment, if all of the first to Nth nozzle groups satisfy the third condition, the number of times of the driving of the ink-jet head 4 is the same as the number of the plurality of nozzles 10 of the ink-jet head 4. However, in the first embodiment, as described later on, the combination of the nozzles 10 for constructing the Nth nozzle group is set so that the possibility is raised for the nozzles to have the same result of the judgment to judge whether or not the nozzles are the ejection-defective nozzles. Therefore, there is such a high possibility that at least one nozzle group of the first to Nth nozzle groups satisfies the first condition or the second condition. Then, if at least one nozzle group, which satisfies the first condition or the second condition, is present in the first to Nth nozzle groups, the number of times of the driving of the ink-jet head 4 is smaller than the number of the plurality of nozzles 10 of the ink-jet head 4.

Further, in the first embodiment, the signal, which is outputted from the judging circuit 68 on the basis of the signal of the electric change of the detecting conducting unit 66 caused by the ink ejected from the nozzle 10, differs between when the ink is ejected from the nozzle 10 and when the ink is not ejected from the nozzle 10. Further, the signal of the electric change of the detecting conducting unit 66 caused by the ink ejected from the nozzle 10 and the signal outputted from the judging circuit 68 on the basis thereof have the voltage values which are proportional to the number of the ejection-defective nozzles.

Further, the nozzles 10, which are mutually aligned adjacently in the conveyance direction and which are included in the plurality of nozzles 10 for constructing the same nozzle array 9, have the short distance therebetween, and such nozzles 10 have the high possibility to have the same result of the judgment to judge whether or not the nozzles are the ejection-defective nozzles. Therefore, in the first embodiment, the two or more nozzles 10 for constructing the first nozzle group are set by selecting the nozzles 10 which are disposed adjacently in the conveyance direction, from the plurality of nozzles 10 of the ink-jet head 4. Accordingly, the possibility is raised to increase the first nozzle groups which satisfy the first condition or the second condition. Then, in this case, the effect is enhanced to successfully decrease the number of times of the driving of the ink-jet head 4 in order to judge whether or not each of the plurality of nozzles 10 is the ejection-defective nozzle.

Further, the possibility is high for the nozzles 10 which mutually constitute the same nozzle array 9 (nozzles 10 which are communicated with the same manifold channel 41 and which have the same color of the ink to be ejected) to have the same result of the judgment to judge whether or not the nozzles 10 are the ejection-defective nozzles. Further, when the distance between the nozzles 10 is small, the possibility is high for the nozzles 10 to have the same result of the judgment to judge whether or not the nozzles 10 are the ejection-defective nozzles. Further, the possibility is especially high to have the same result of the judgment to judge whether or not the nozzles 10 are the ejection-defective nozzles, in relation to the nozzles 10 which are disposed adjacently in the conveyance direction and which are included in the nozzles 10 for constructing the same nozzle array 9. Further, the possibility is high to have the same result of the judgment to judge whether or not the nozzles are the ejection-defective nozzles, in relation to the nozzles which have similar elapsed times after the liquid ejection head is driven last time so that the liquid is discharge.

In view of the above, in the first embodiment, in the Nth group grouping process performed if the variable N is not less than 2, as described above, the candidates of the combination of the nozzles 10 for the Nth nozzle group are set on the basis of the nozzle array 9 (concerning the color of the ink to be ejected and the communicated manifold channel 41). Then, if the plurality of candidates are present, in the following procedure, the plurality of candidates are refined respectively on the basis of distance between the nozzles 10 in each of the Nth nozzle groups, the number of the Nth nozzle groups constructed by the nozzles 10 which are disposed adjacently in the conveyance direction, and the elapsed time after the discharge performed last time in relation to the nozzles 10 for constructing the Nth nozzle group. Accordingly, the possibility is raised to increase the number of the Nth nozzle groups which satisfy the first condition or the second condition. As a result, the effect is enhanced to successfully decrease the number of times of the driving of the ink-jet head 4 required to judge whether or not each of the plurality of nozzles 10 is the ejection-defective nozzle.

Further, in the first embodiment, the ejection-defective nozzle can be recovered by performing the flashing in which the ink is discharged from the ejection-defective nozzle after the nozzle judgment process.

Further, in the first embodiment, the ink-jet head 4 is driven so that the ink is individually ejected from each of the ejection-defective nozzles after the flashing, and it is judged whether or not the ejection-defective nozzle is recovered on the basis of the signal outputted from the judging circuit in this situation. Then, if any ejection-defective nozzle, which is not recovered, is present, the suction purge is performed. Accordingly, the suction purge, in which the discharge amount of the ink is large as compared with the flashing, is performed only when any ejection-defective nozzle, which cannot be recovered by the flashing, is present. It is possible to maximally decrease the amount of the ink discharged in order to recover the ejection-defective nozzle.

Further, in the first embodiment, the nozzle judgment process is executed as described above at any timing other than the timing at which the recording is performed on the recording paper P, and it is judged whether or not each of the plurality of nozzles 10 of the ink-jet head 4 is the ejection-defective nozzle. On the contrary, the plurality of nozzles 10 of the ink-jet head 4 are classified into the plurality of first nozzle groups, immediately before the recording is performed on the recording paper P. After that, unlike the above, the flashing is performed so that the ink is discharged from the nozzles 10 for constructing the first nozzle group which satisfies the second condition and the first nozzle group which satisfies the third condition.

In this case, as for the first nozzle group which satisfies the third condition, the ink is also discharged by the flashing from some of the nozzles 10 which are not the ejection-defective nozzles. The discharge amount of the ink is increased. However, in this procedure, it is possible to maximally shorten the time until the recording is started on the recording paper P after the recording instruction for instructing the recording on the recording paper P is inputted.

Second Embodiment

Next, an explanation will be made about a second embodiment of the present disclosure. In the second embodiment, the judging circuit 68 compares the maximum voltage value Vm of the signal outputted from the detecting conducting unit 66 with a threshold value which corresponds to a case in which the ink is not ejected from any nozzle 10 (all nozzles 10 are the ejection-defective nozzles) when the ink is simultaneously ejected from the two or more nozzles 10 and a threshold value which corresponds to a case in which the ink is ejected from all nozzles 10 (all nozzles 10 are not the ejection-defective nozzles), and a signal, which has a voltage value corresponding to the result of the comparison, is outputted. That is, if the ink is simultaneously ejected from the two or more nozzles 10, the judging circuit 68 outputs the signal which differs among when all of the nozzles 10 of the two or more nozzles are not the ejection-defective nozzles, when all of the nozzles 10 are the ejection-defective nozzles, and when only some of the nozzles 10 are the ejection-defective nozzles. Therefore, in the second embodiment, unlike the first embodiment, when the ink is ejected from the three or more nozzles 10, if only some of the nozzles 10 are the ejection-defective nozzles, then it is impossible to acquire the number of the ejection-defective nozzles from the signal outputted from the judging circuit 68.

<Nozzle Judgment Process>

Figure 13A:
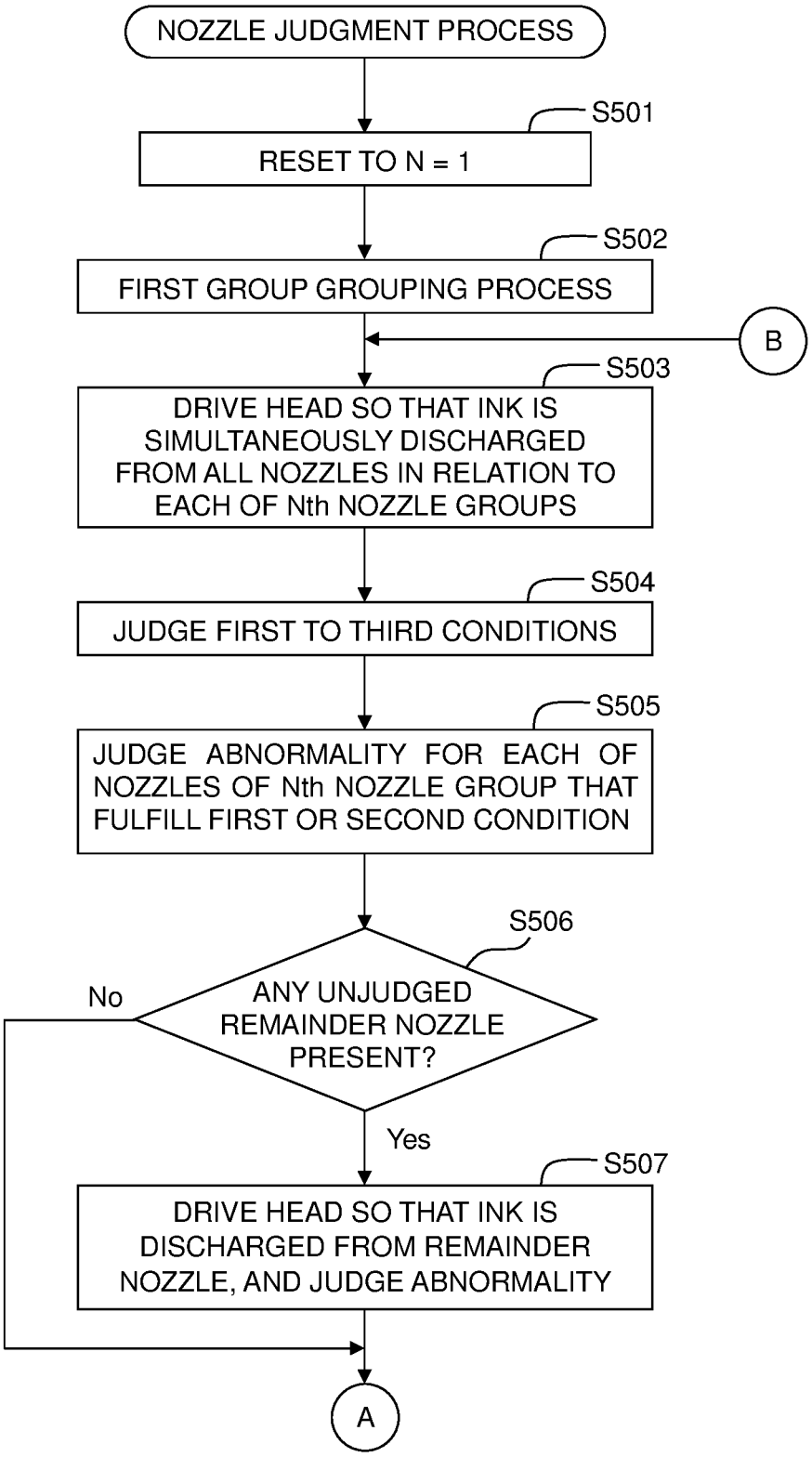
FIGS. 13A and 13B depict flow chart illustrating a flow of the nozzle judging process of a second embodiment.
Figure 13B:
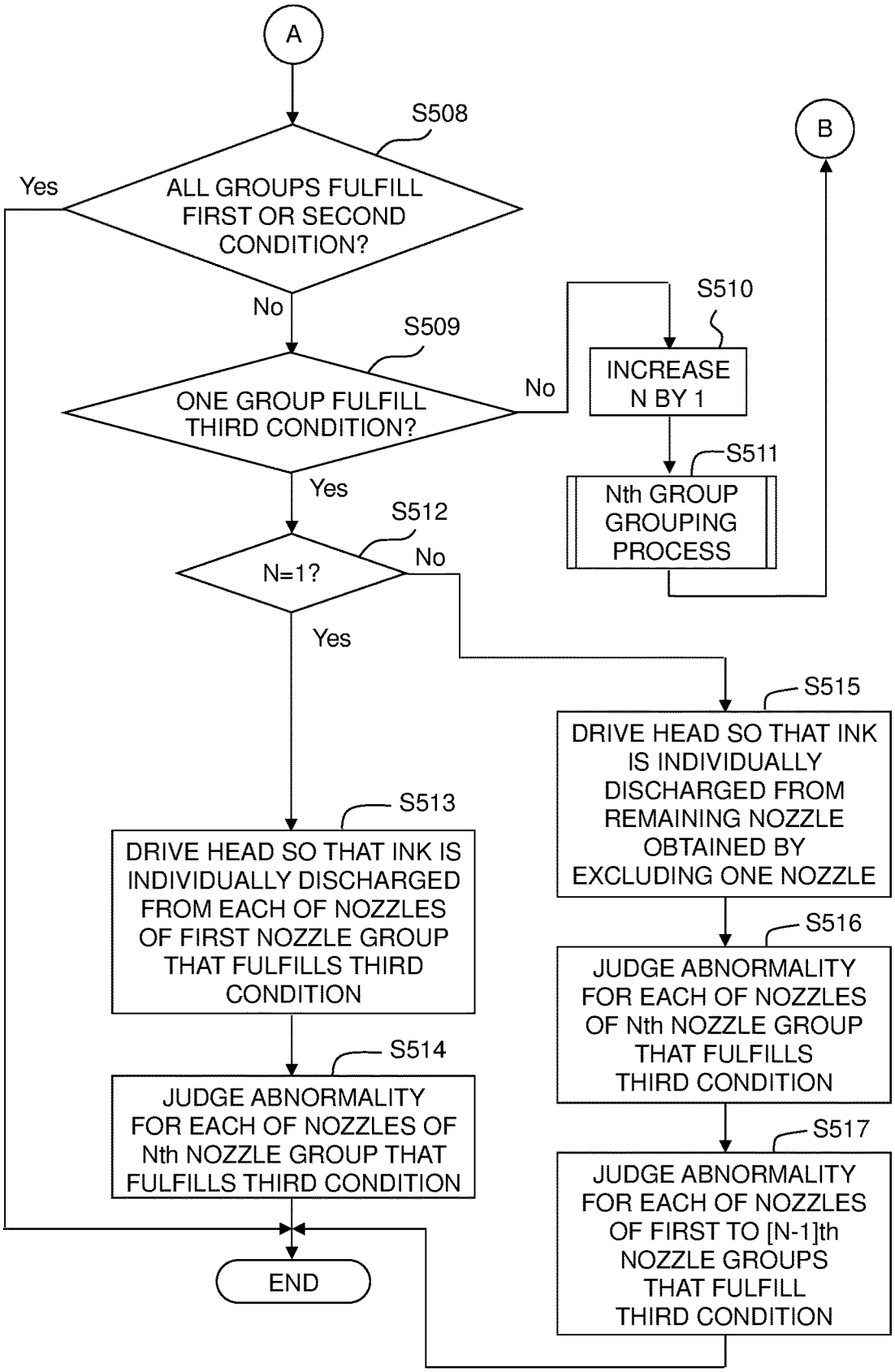

Then, in the second embodiment, the controller 80 executes the process in accordance with a flow depicted in FIGS. 13A and 13B in the nozzle judgment process. The process will be explained in detail. The controller 80 executes the processes of S501 to S509 which are the same as or equivalent to the processes of S201 to S209 of the first embodiment. However, in the second embodiment, in the first group grouping process of S502, the plurality of nozzles 10 of the ink-jet head 4 are classified into a plurality of first nozzle groups each of which is composed of three or more nozzles 10.

Further, if a plurality of Nth nozzle groups, which satisfy the third condition, are present (S509: NO), the controller 80 executes the processes of S510, S511 which are the same as or equivalent to S214, S215 of the first embodiment. However, in the second embodiment, in the Nth group grouping process of S511, the remaining nozzles 10, which are obtained by excluding one nozzle 10 from each of the plurality of [N−1]th nozzle groups that satisfy the third condition, are classified into Nth nozzle groups each of which is composed of two nozzles 10 and which have combinations of the nozzles 10 different from those of the first to [N−1]th nozzle groups.

Further, if only one Nth nozzle group, which satisfies the third condition, is present (S509: YES), and N is 1 (S512: YES), then the controller 80 drives the ink-jet head 4 so that the ink is individually ejected from each of the three or more nozzles 10 for constructing the first nozzle group which satisfies the third condition (S513). Then, it is judged whether or not each of the three or more nozzles 10 for constructing the first nozzle group which satisfies the third condition is the ejection-defective nozzle on the basis of the signal outputted from the judging circuit 68 in this situation (S514).

On the other hand, if only one Nth nozzle group, which satisfies the third condition, is present (S509: YES), and N is not less than 2 (S512: NO), then the controller 80 executes the processes of S515 to S517 which are the same as or equivalent to S210, S211, S213 of the first embodiment. Then, in the second embodiment, it is judged whether or not each of the plurality of nozzles 10 of the ink-jet head 4 is the ejection-defective nozzle in accordance with the nozzle judgment process explained above.

<Judgment to Judge Whether or not Nozzle is Ejection-Defective Nozzle by Nozzle Judgment Process>

Next, an explanation will be made while referring to specified examples about the judgment to judge whether or not each of the plurality of nozzles 10 of the ink-jet head 4 is the ejection-defective nozzle in accordance with the nozzle judgment process of the second embodiment. In this section, an example will be explained with reference to FIGS. 14A to 14F, when the number of the nozzles 10 for constructing the first nozzle group is three.

In this example, in the first nozzle group grouping process of S502, eighteen nozzles n1 to n18 are classified into six first nozzle groups G11 to G16 each of which is composed of three nozzles 10 as depicted in FIG. 14A. Then, it is judged that the nozzles n1 to n3, n16 to n8, which constitute the first nozzle groups G11, G16 that satisfy the first condition, are not the ejection-defective nozzles, and it is judged that the nozzles 10 of n7 to n9, which constitute the first nozzle group G13 that satisfies the second condition, are the ejection-defective nozzles (S505).

Further, the three first nozzle groups G12, G14, G15 satisfy the third condition (S509: NO). Therefore, in the second group grouping process (S511), for example, as depicted in FIG. 14B, the nozzles 10 of n4 to n6, n10 to n12, n13, n14, which are included in the nozzles 10 of n4 to n6, n10 to n12, n13 to n15 for constructing the first nozzle groups G12, G14, G15, are classified into four second nozzle groups G21 to G24 each of which is composed of two nozzles 10. Then, it is judged that the nozzles n5, n13, which constitute the second nozzle group G22 that satisfies the first condition, are not the ejection-defective nozzles, and it is judged that the nozzles 10 of n6, n11, which constitute the second nozzle group G23 that satisfies the second condition, are the ejection-defective nozzles (S505). Further, as depicted in FIG. 14C, the ink-jet head 4 is driven so that the ink is ejected from the nozzle 10 of n5 which is the remainder nozzle that was leftover in the second group grouping process. It is judged that the nozzle 10 of n15 is the ejection-defective nozzle on the basis of the signal outputted from the judging circuit 68 in this situation (S507).

Further, in this example, the two nozzle groups G21, G24 satisfy the third condition (S509: NO). Therefore, in accordance with the third group grouping process (S511), for example, as depicted in FIG. 14D, a third nozzle group G31 is formed by n4, n12 which are obtained by excluding one nozzle from each of the two second nozzle groups G21, G24 that satisfy the third condition (S511). Then, the one third nozzle group G31 satisfies the third condition. Therefore, for example, as depicted in FIG. 14E, the ink-jet head 4 is driven so that the ink is ejected from the remaining nozzle 10 of n4 obtained by excluding one nozzle from n4, n12 for constructing the third nozzle group G31 (S515). It is judged that the nozzle 40 of n4 is the ejection-defective nozzle from the signal outputted from the judging circuit 68 in this situation (S516). Further, according to this result and the result depicted in FIG. 14D, it is judged that the nozzle 10 of n12 is not the ejection-defective nozzle.

Then, in the following procedure, it is successively judged whether or not the remaining nozzles 10, for which it has not been judged whether or not the nozzles 10 are the ejection-defective nozzles, are the ejection-defective nozzles, according to the information of the nozzle 10 for which it has been judged whether or not the nozzle 10 is the ejection-defective nozzle and the results depicted in FIGS. 14A to 14E (S517). Accordingly, as depicted in FIG. 14F, it is possible to judge whether or not the nozzles 10 of n1 to n18 are the ejection-defective nozzles.

In this example, the plurality of first nozzle groups, which satisfy the third condition, are present. However, only one first nozzle group, which satisfies the third condition, may be present. In this case, for example, if only the first nozzle group G12 satisfies the third condition, the ink-jet head is driven so that the ink is individually ejected from each of the nozzles 10 of n4 to n6 (S513). Then, it is judged whether or not each of the nozzles 10 of n4 to n6 is the ejection-defective nozzle on the basis of the signal outputted from the judging circuit 68 when the ink is ejected from each of the nozzles 10 (S514).

<Effect of Second Embodiment>

In the second embodiment, the plurality of nozzles 10 of the ink-jet head 4 are classified into the plurality of first nozzle groups each of which is composed of the three or more nozzles 10. Then, the ink-jet head 4 is driven so that the ink is simultaneously ejected from the three or more nozzles 10 in relation to each of the plurality of first nozzle groups. It is judged which condition of the first to third conditions is satisfied by each of the plurality of first nozzle groups on the basis of the signal outputted from the judging circuit 68 in this situation.

Then, if the plurality of first nozzle groups, which satisfy the third condition, are present, the two or more nozzles 10 of each of the plurality of first nozzle groups which satisfy the third condition are classified into the second nozzle groups each of which is composed of the two nozzles 10, while changing the combination of the nozzles as compared with the plurality of first nozzle groups. It is judged which condition of the first to third conditions is satisfied by each of the second nozzle groups.

Further, the following operation is repeated for the case in which the variable N is not less than 3 until all of the Nth nozzle groups satisfy the first condition or the second condition or only one Nth nozzle group satisfies the third condition. That is, the nozzles, which are obtained by excluding one nozzle of the two nozzles in relation to each of the plurality of [N−1]th nozzle groups that satisfy the third condition, are classified into the Nth nozzle groups each of which is composed of the two nozzles 10, while changing the combination of the nozzles as compared with the plurality of first to [N−1]th nozzle groups, and it is judged which condition of the first to third conditions is satisfied by each of the Nth nozzle groups.

It is understood that all of the nozzles 10, which constitute the Nth nozzle group that satisfies the first condition, are not the ejection-defective nozzles. Further, it is understood that all of the nozzles 10, which constitute the Nth nozzle group that satisfies the second condition, are the ejection-defective nozzles. Then, as for the Nth nozzle group which satisfies the first condition or the second condition, it is possible to decrease the number of times of the driving of the ink-jet head 4 required to judge whether or not the nozzle is the ejection-defective nozzle, as compared with a case in which it is judged whether or not the nozzle is the ejection-defective nozzle by driving the ink-jet head 4 so that the liquid is individually ejected from each of the nozzles.

Further, if only one first nozzle group, which satisfies the third condition, is present, the ink-jet head 4 is driven so that the ink is individually ejected from the three or more nozzles 10 for constructing the one first nozzle group. Accordingly, it is possible to judge whether or not each of the three or more nozzles 10 for constructing the one Nth nozzle group is the ejection-defective nozzle on the basis of the signal outputted from the judging circuit 68 when the ink is ejected from each of the three or more nozzles 10 for constructing the one Nth nozzle group.

Further, when the variable N is not less than 2, if only one Nth nozzle group, which satisfies the third condition, is present, then the ink-jet head 4 is driven so that the ink is ejected from the remaining nozzle 10 obtained by excluding one nozzle 10 from the one Nth nozzle group. Accordingly, it is possible to judge whether or not each of the two nozzles 10 for constructing the one Nth nozzle group is the ejection-defective nozzle on the basis of the signal outputted from the judging circuit 68 when the ink-jet head 4 is driven so that the ink is individually ejected from the remaining nozzle 10 of the one Nth nozzle group.

Further, it is possible to judge whether or not each of the nozzles 10 for constructing the first to [N−1]th nozzle groups which satisfy the third condition is the ejection-defective nozzle on the basis of the result obtained as described above and the signal outputted from the judging circuit 68 when the ink is simultaneously ejected from the two or more nozzles 10 for constructing the nozzle group in relation to each of the first to [N−1]th nozzle groups which satisfy the third condition.

Then, according to the fact as described above, it is possible to maximally decrease the number of times of the driving of the ink-jet head 4 required to judge whether or not each of the plurality of nozzles 10 of the ink-jet head 4 is the ejection-defective nozzle. In the case of the second embodiment, the larger the number of the first nozzle groups which satisfy the first condition or the second condition is, the smaller the number of times of the driving of the ink-jet head 4 is. Note that in the case of the second embodiment, for example, when the number of the first nozzle group or nozzle groups which satisfy(s) the first condition or the second condition is zero or small, the number of times of the driving of the ink-jet head 4 may be possibly larger than the number of the nozzles 10 of the ink-jet head 4. However, also in the second embodiment, the combination of the nozzles 10 for constructing the Nth nozzle group is set so that the possibility is raised for the nozzles to have the same result of the judgment to judge whether or not the nozzles are the ejection-defective nozzles. Therefore, there is such a high possibility that the number of the first nozzle groups which satisfy the first condition or the second condition is increased. Then, in this case, the number of times of the driving of the ink-jet head 4 can be smaller than the number of the plurality of nozzles 10 of the ink-jet head 4.

Modified Embodiment

The first and second embodiments of the present disclosure have been explained. However, the present disclosure is not limited to the first and second embodiments, and the present disclosure can be variously changed or modified as long as within the range defined in claims.

In the first embodiment, the number of the nozzles 10 for constructing the Nth nozzle group is the same irrelevant to the variable N. However, the present disclosure is not limited thereto. In the first embodiment, the number of the nozzles 10 for constructing the Nth nozzle group may differ depending on the variable N.

Further, in the first and second embodiments, the following operation is repeated until all of the Nth nozzle groups satisfy the first condition or the second condition, or only one Nth nozzle group satisfies the third condition. That is, the remaining nozzles 10, which are obtained by excluding one nozzle 10 from each of the plurality of [N−1]th nozzle groups which satisfy the third condition, are classified into the Nth nozzle groups, and it is judged whether each of the Nth nozzle groups satisfies the first condition, satisfies the second condition, or satisfies the third condition. However, the present disclosure is not limited thereto.

For example, the following procedure is also available. That is, when the variable N is not less than 2 in the first and second embodiments, if a plurality of Nth nozzle groups, which satisfy the third condition, are present, then the ink-jet head 4 is driven so that the ink is individually ejected from each of the remaining nozzles 10 obtained by excluding one nozzle 10 in relation to each of the plurality of Nth nozzle groups which satisfy the third condition, and it is judged whether or not each of the nozzles 10 is the ejection-defective nozzle.

Further, in the processes of S210, S211 of the first embodiment and S515, S516 of the second embodiment, the ink-jet head 4 is driven so that the ink is individually ejected from each of the remaining nozzles 10 obtained by excluding one nozzle 10 from the nozzles 10 for constructing the Nth nozzle group which satisfies the third condition. Then, it is judged whether or not each of the nozzles 10 for constructing the Nth nozzle group which satisfies the third condition is the ejection-defective nozzle, on the basis of the signal outputted from the judging circuit 68 when the ink-jet head 4 is driven so that the ink is ejected from each of the nozzles 10 and the number of the ejection-defective nozzles obtained from the signal outputted from the judging circuit 68 when the ink-jet head 4 is driven so that the ink is simultaneously ejected from all of the nozzles 10 for constructing the Nth nozzle group which satisfies the third condition. However, the present disclosure is not limited thereto. For example, the following procedure is also available. That is, the ink-jet head 4 is driven so that the ink is individually ejected from each of the nozzles 10 for constructing the Nth nozzle group which satisfies the third condition, and it is judged whether or not each of the nozzles 10 for constructing the Nth nozzle group which satisfies the third condition is the ejection-defective nozzle on the basis of the signal outputted from the judging circuit 68 when the ink-jet head 4 is driven so that the ink is ejected from each of the nozzles 10.

Further, in the first embodiment, the value of the signal outputted from the judging circuit 68 is proportional to the number of the ejection-defective nozzles. However, the present disclosure is not limited thereto. For example, in the first embodiment, the value of the signal outputted from the judging circuit 68 may be inversely proportional to the number of the ejection-defective nozzles. Also in this case, it is possible to acquire the number of the ejection-defective nozzles on the basis of the signal outputted from the judging circuit 68.

Further, in the first and second embodiments, when the remaining nozzles 10, which are obtained by excluding one nozzle 10 from each of the plurality of [N−1]th nozzle groups that satisfy the third condition, are classified into the Nth nozzle groups in the Nth group grouping process if the variable N is not less than 2, the candidate of the combination of the nozzles 10 in the Nth nozzle group is set on the basis of the nozzle array 9 (color of the ink to be ejected, communicated manifold channel 41). Then, if the plurality of candidates are present, in the following procedure, the plurality of candidates are refined respectively on the basis of the distance between the nozzles 10 in each of the Nth nozzle groups, the number of the Nth nozzle groups constructed by the nozzles 10 disposed adjacently in the conveyance direction, and the elapsed time elapsed after the discharge performed last time. However, the present disclosure is not limited thereto.

For example, the candidate of the combination of the nozzles 10 in the Nth nozzle group may be set on the basis of the any criterion other than the color of the ink to be ejected, of the four criteria of the color of the ink to be ejected, the distance between the nozzles 10 in each of the Nth nozzle groups, the number of the Nth nozzle groups constructed by the nozzles 10 disposed adjacently in the conveyance direction, and the elapsed time elapsed after the discharge performed last time. Then, if the plurality of candidates are present, the candidates may be refined by using the remaining three criteria in an arbitrary order. Further, the candidate may be set and refined on the basis of only some of the criteria of the four criteria. Further, the candidate may be set on the basis of only one criterion of the four criteria. If the plurality of candidates are present, the combination of the nozzles 10 for constructing the Nth nozzle group may be set on the basis of any one of the candidates.

Further, in the first and second embodiments, the nozzles 10, which constitute each of the plurality of first nozzle groups, are set by selecting the nozzles 10 which are disposed adjacently in the conveyance direction, from the plurality of nozzles 10 of the ink-jet head 4. However, the present disclosure is not limited thereto. The nozzles 10, which constitute at least some of the first nozzle groups of the plurality of first nozzle groups, may be, for example, the nozzles 10 which are not disposed adjacently in the conveyance direction of the same nozzle array 9 or the nozzles 10 which constitute any different nozzle array 9.

Further, in the first and second embodiments, it is judged whether or not each of the plurality of nozzles 10 of the ink-jet head 4 is the ejection-defective nozzle in accordance with the nozzle judgment process as described above at the timing immediately before the execution of the recording on the recording paper P. On the other hand, at the timing immediately before the execution of the recording on the recording paper P, the plurality of nozzles 10 of the ink-jet head 4 are classified into the plurality of first nozzle groups, and the flashing is performed so that the ink is discharged from each of the nozzles 10 for constructing the first nozzle group which satisfies the second and third conditions. However, the present disclosure is not limited thereto. For example, even at the timing immediately before the execution of the recording on the recording paper P, it may be judged whether or not each of the plurality of nozzles 10 of the ink-jet head 4 is the ejection-defective nozzle in accordance with the nozzle judgment process as described above, and the flashing may be performed to discharge the ink from the ejection-defective nozzle.

Further, in the first and second embodiments, the flashing is performed so that the ink is discharged from the ejection-defective nozzle after the nozzle judgment process. If the ejection-defective nozzle, which is not recovered by the flashing, is present, the suction purge is performed. However, the present disclosure is not limited thereto.

Figure 15:
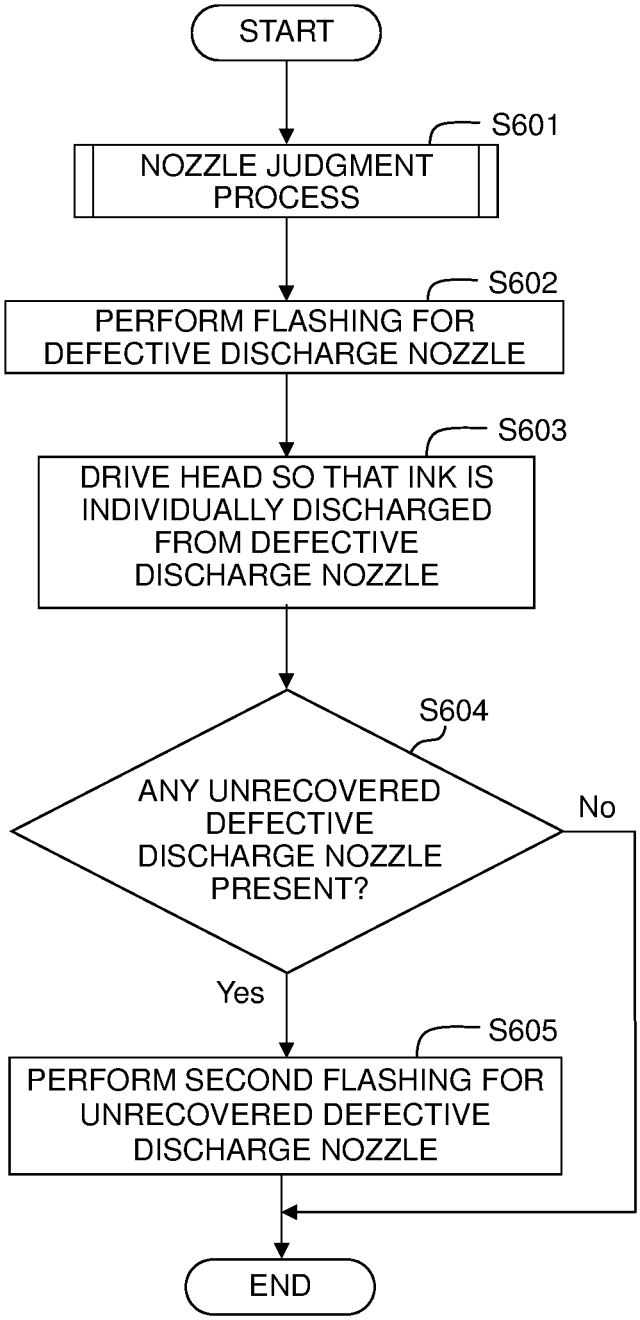
FIG. 15 depicts a flow chart illustrating a flow of the process when the viscosity of the ink contained in the nozzle is estimated at a timing other than a timing provided immediately before the recording on the recording paper in a modified embodiment.

In one modified embodiment, the ink-jet head 4 can selectively perform, as the flashing, any one of the first flashing and the second flashing in which the discharge amount of the ink is larger than that of the first flashing. Then, in this modified embodiment, as depicted in FIG. 15, the first flashing is performed so that the ink is discharged from the ejection-defective nozzle (S602) after the nozzle judgment process (S601). Subsequently, the ink-jet head 4 is driven so that the ink is individually discharged from the ejection-defective nozzle toward the detecting conducting unit 66 (S603). Then, it is judged whether or not any unrecovered ejection-defective nozzle is present on the basis of the signal outputted from the judging circuit 68 in this situation (S604). If any unrecovered ejection-defective nozzle is not present (S604: NO), the process is terminated as it is. If any unrecovered ejection-defective nozzle is present (S604: YES), then the second flashing is performed so that the ink is discharged from the unrecovered ejection-defective nozzle (S605), and the process is terminated.

In this modified embodiment, the ink is discharged from the ejection-defective nozzle by means of the first flashing in which the discharge amount of the ink is small, and it is judged whether or not the ejection-defective nozzle is recovered. Then, only when the ejection-defective nozzle, which is not recovered by the first flashing, is present, the ink is discharged from the ejection-defective nozzle which is not recovered by the first flashing, by means of the second flashing in which the discharge amount of the ink is large. Accordingly, it is possible to maximally decrease the amount of the ink discharged to recover the ejection-defective nozzle.

Further, in the first and second embodiments, the ejection-defective nozzle is recovered by discharging the ink from the ejection-defective nozzle. However, the present disclosure is not limited thereto. For example, the conveyance amount may be changed in at least a part of the conveyance operation during the recording on the basis of what nozzle 10 of the plurality of nozzles 10 of the ink-jet head 4 is the ejection-defective nozzle, and the dot of the image to be recorded, which corresponds to the ejection-defective nozzle, may be allotted to another nozzle 10 which is not the ejection-defective nozzle to perform the recording pass.

Further, in the first and second embodiments, the ink contained in the ink-jet head 4 is discharged from the plurality of nozzles 10 by means of the suction purge. However, the present disclosure is not limited thereto. For example, a pressurizing pump may be provided at an intermediate portion of the tube 13 which connects the subtank 3 and the ink cartridge 15. Alternatively, the printer may be provided with a pressurizing pump which is connected to the ink cartridge. Then, it is also allowable to perform the so-called suction purge in which the ink contained in the ink-jet head 4 is pressurized to discharge the ink contained in the ink-jet head 4 from the nozzles 10 by driving the pressurizing pump in a state in which the plurality of nozzles 10 are covered with the cap 61. Note that in this case, the combination of the cap 61 and the pressurizing pump corresponds to the "purge unit" of the present disclosure.

Further, in the purge, it is also allowable to perform both of the suction with the suction pump 62 and the pressurization with the pressurizing pump. In this case, the combination of the maintenance unit 8 and the pressurizing pump corresponds to the "purge unit" of the present disclosure.

Further, in the first embodiment, the ink is ejected from the nozzle 10 by applying the pressure to the ink contained in the pressure chamber 40 by means of the driving element 50. However, the present disclosure is not limited thereto. For example, the ink may be ejected from the nozzle by heating the ink to generate bubbles in the ink channel.

Further, in the embodiment described above, the signal is outputted from the judging circuit 68 in order to judge whether or not the nozzle is the ejection-defective nozzle and/or acquire the number of the ejection-defective nozzles, depending on the maximum voltage value Vm of the detecting conducting unit 66 as obtained when the ink is ejected from the nozzle 10 toward the detecting conducting unit 66. However, the present disclosure is not limited thereto.

For example, a detecting electrode, which extends in the upward-downward direction, may be arranged. It is also allowable to output, from the judging circuit, the signal in order to judge whether or not the nozzle is the ejection-defective nozzle and/or acquire the number of the ejection-defective nozzles, depending on the voltage value of the detecting electrode as obtained when the ink is ejected so that the ink passes from the nozzle 10 through an area opposed to the detecting electrode. Alternatively, an optical sensor may be provided, which detects the ink ejected from the nozzle 10 and which distinguishes and detects the number of the inks ejected simultaneously. It is also allowable to output, from the optical sensor, the signal in order to judge whether or not the nozzle is the ejection-defective nozzle and/or acquire the number of the ejection-defective nozzles.

Alternatively, for example, in the same manner as described in US2007/0139461, a voltage detecting circuit ("signal output circuit" of the present disclosure), which detects the voltage change when the ink is ejected from the nozzle, may be connected to the plate on which the nozzles of the ink-jet head are formed. The signal, which depends on whether or not the nozzle 10 is the ejection-defective nozzle and which depends on the number of the ejection-defective nozzles, may be outputted from the voltage detecting circuit to the controller 80.

Alternatively, for example, in the same manner as described in US2014/0300657, the ink-jet head may have a substrate which is provided with a temperature detecting element. Then, a first applied voltage may be applied to drive a heater in order to discharge the ink. After that, a second applied voltage may be applied to drive the heater so that the ink is not ejected. The signal, which corresponds to whether or not the nozzle 10 is the ejection-defective nozzle and which corresponds to the number of the ejection-defective nozzles, may be outputted on the basis of the temperature change detected by the temperature detecting element during a period until a predetermined time elapses after applying the second applied voltage. The disclosures of US2007/0139461 and US2014/0300657 are incorporated herein by reference.

Further, in the embodiment described above, the ink-jet head 4 is the so-called serial type head in which the ink-jet head 4 is carried on the carriage 2 and the ink is ejected from the plurality of nozzles 10 while being moved in the scanning direction. However, the present disclosure is not limited thereto. For example, the ink-jet head may be a so-called line head in which the ink-jet head extends over the entire length of the recording paper P in the scanning direction. In the embodiment described above, the controller 80 classifies the plurality of nozzles 10 of the ink-jet head 4 into a plurality of first nozzle groups each of which is composed of two or more nozzles 10 in the first group grouping process of S202. However, the present disclosure is not limited thereto. For example, the plurality of nozzles 10 of the ink-jet head 4 may be preliminary classified into a plurality of first nozzle groups.

In the foregoing description, the example has been explained, in which the present disclosure is applied to the printer for performing the recording on the recording paper P by ejecting the ink from the nozzles. However, the present disclosure is not limited thereto. The present disclosure is also applicable to any image recording apparatus for recording the image on any recording medium other than the recording paper, including, for example, T-shirts, sheets for outdoor advertisements, cases for mobile phone terminals such as smartphones or the like, corrugated cardboards, and resin members. Further, the present disclosure is also applicable to any liquid ejection apparatus for ejecting any liquid other than the ink, including, for example, metals and resins in liquid states.

What is claimed is:

1. A liquid ejection apparatus comprising:

a liquid ejection head including a plurality of nozzles forming a plurality of first nozzle groups, each of the first nozzle groups including two or more nozzles of the plurality of nozzles;

a signal output circuit configured to output a signal in response to a discharge of a liquid from a nozzle of the plurality of the nozzles, a signal in response to a normal discharge of the liquid being different from a signal in response to a defective discharge of the liquid, and in a case that the liquid is simultaneously ejected from two or more nozzles of the plurality of nozzles, the signal output circuit being configured to output different signals depending on the number of ejection-defective nozzles that undergo occurrence of the defective discharge of the liquid; and a controller configured to:

drive the liquid ejection head such that the liquid is simultaneously ejected from the two or more nozzles in each of the first nozzle groups; and judge, based on the signal output from the signal output circuit, whether a first condition, a second condition or a third condition is satisfied, the first condition being a condition in which the ejection-defective nozzles are absent in the two or more nozzles of each of the first nozzle groups, the second condition being a condition in which all of the two or more nozzles of each of the first nozzle groups are the ejection-defective nozzles, and the third condition being the condition in which a part of the two or more nozzles of each of the first nozzle groups are the ejection-defective nozzles, wherein in a case that the controller judges that two or more first nozzle groups in the first nozzle groups satisfy the third condition, the controller is configured to:

classify at least some of the nozzles in the two or more first nozzle groups that satisfy the third condition, into at least one second nozzle group, each of the at least one second nozzle group including two or more nozzles and having a different combination of the plurality of nozzles as compared with the plurality of first nozzle groups;

drive the liquid ejection head such that the liquid is simultaneously ejected from the two or more nozzles of each of the at least one second nozzle group; and judge, based on the signal output from the signal output circuit, whether the first condition is satisfied, the second condition is satisfied, or the third condition is satisfied.

2. The liquid ejection apparatus according to claim 1, wherein the controller is configured to classify the plurality of nozzles into the plurality of first nozzle groups such that each of the first nozzle groups includes the two or more nozzles.

3. The liquid ejection apparatus according to claim 1, wherein the signal output circuit includes a detecting conductor, and the signal output circuit is configured to output a signal in response to an electric change in the detecting conductor generated by the liquid ejected from the plurality of nozzles.

4. The liquid ejection apparatus according to claim 1, wherein:

the plurality of nozzles is arranged in one direction; and the controller is configured to select the two or more nozzles of the plurality of first nozzle groups from the plurality of nozzles such that the two or more nozzles are adjacent to one another in the one direction.

5. The liquid ejection apparatus according to claim 1, wherein the signal output circuit is configured such that an output value of the signal output from the signal output circuit differs in direct proportion to or in inverse proportion to the number of ejection-defective nozzles.

6. The liquid ejection apparatus according to claim 5, wherein in a case that the controller judges that two or more first nozzle groups in the first nozzle groups satisfy the third condition, the controller is configured to classify remaining nozzles, which are obtained by excluding one of the nozzles from each of the two or more first nozzle groups that satisfy the third condition, into the at least one second nozzle group.

7. The liquid ejection apparatus according to claim 6, wherein in a case that the controller judges that only one first nozzle group of the first nozzle groups satisfies the third condition, the controller is configured to:

drive the liquid ejection head such that the liquid is individually ejected from the remaining nozzles; and judging whether or not each of the two or more nozzles of the one first nozzle group is the ejection-defective nozzle, based on a signal output from the signal output circuit in response to the liquid ejection head being driven such that the liquid is simultaneously ejected from the two or more nozzles of the one first nozzle group and based on a signal output from the signal output circuit in response to the liquid ejection head being driven such that the liquid is individually ejected from the remaining nozzles of the one first nozzle group.

8. The liquid ejection apparatus according to claim 5, wherein in a case that the controller judges that only one second nozzle group of the at least one second nozzle group satisfies the third condition, the controller is configured to:

drive the liquid ejection head such that the liquid is individually ejected from remaining nozzles obtained by excluding one nozzle from the one second nozzle group; and judging whether or not each of the two or more nozzles of the one second nozzle group is the ejection-defective nozzle, based on a signal output from the signal output circuit in response to the liquid ejection head being driven such that the liquid is simultaneously ejected from the two or more nozzles of the one second nozzle group and based on a signal output from the signal output circuit in response to the liquid ejection head being driven such that the liquid is individually ejected from the remaining nozzles of the one second nozzle group.

9. The liquid ejection apparatus according to claim 6, wherein in a case that the controller judges that two or more second nozzle groups in the at least one second nozzle group satisfy the third condition, the controller is configured to:

classifying remaining nozzles which are obtained by excluding one of the nozzles from each of the two or more second nozzle groups into at least one third nozzle group, each of the at least one third nozzle group including two or more nozzles and having a combination of the nozzles different from those of the plurality of first nozzle groups and the at least one second nozzle group, and the controller is configured to:

drive the liquid ejection head such that the liquid is simultaneously ejected from the two or more nozzles of each of the at least one third nozzle group; and judge whether the first condition is satisfied, the second condition is satisfied, or the third condition is satisfied based on a signal output from the signal output circuit.

10. The liquid ejection apparatus according to claim 9, wherein N is a natural number of not less than 2, the controller is configured to repeat:

classifying remaining nozzles obtained by excluding one nozzle from each of two or more [N−1]th nozzle groups which satisfy the third condition into at least one Nth nozzle group, each of the at least one Nth nozzle group including two or more nozzles and having a combination of the nozzles different from those of the first to [N−1]th nozzle groups;

driving the liquid ejection head such that the liquid is simultaneously ejected from the two or more nozzles in each of the at least one Nth nozzle group; and judging whether the first condition is satisfied, the second condition is satisfied, or the third condition is satisfied on the basis of a signal outputted from the signal output circuit, until all of the at least one Nth nozzle group satisfy the first condition or the second condition, or only one Nth nozzle group in the at least one Nth nozzle group satisfies the third condition, and in a case that the controller judges that only one Nth nozzle group of the at least one Nth nozzle group satisfies the third condition, the controller is configured to:

drive the liquid ejection head such that the liquid is individually ejected from remaining nozzles obtained by excluding one nozzle from the one Nth nozzle group; and judge whether or not each of the two or more nozzles of the one Nth nozzle group is the ejection-defective nozzle, based on a signal output from the signal output circuit in response to the liquid ejection head being driven such that the liquid is simultaneously ejected from the two or more nozzles of the one Nth nozzle group and based on a signal output from the signal output circuit in response to the liquid ejection head being driven such that the liquid is individually ejected from the remaining nozzles of the one Nth nozzle group.

11. The liquid ejection apparatus according to claim 1, wherein in a case that the liquid is simultaneously ejected from two or more nozzles of the plurality of nozzles, the signal output circuit is configured to output different signals among when all of the nozzles of the two or more nozzles are not the ejection-defective nozzles, when all of the nozzles are the ejection-defective nozzles, and when only some of the nozzles are the ejection-defective nozzles, and in a case that the controller judges that the two or more first nozzle groups satisfy the third condition, the controller is configured to classify the nozzles in the two or more first nozzle groups that satisfy the third condition, into the at least one second nozzle group, each of the at least one second nozzle group including two nozzles and having a different combination of the nozzles as compared with the plurality of first nozzle groups.

12. The liquid ejection apparatus according to claim 11, wherein in a case that the controller judges that only one first nozzle group of the first nozzle groups satisfies the third condition, the controller is configured to:

drive the liquid ejection head such that the liquid is individually ejected from each of the two or more nozzles of the one first nozzle group; and judge whether or not each of the two or more nozzles of the one first nozzle group is the ejection-defective nozzle based on a signal output from the signal output circuit.

13. The liquid ejection apparatus according to claim 11, wherein in a case that the controller judges that only one second nozzle group of the at least one second nozzle group satisfies the third condition, the controller is configured to:

drive the liquid ejection head such that the liquid is ejected from one of the two nozzles of the one second nozzle group; and judge whether or not each of the two nozzles of the one second nozzle group is the ejection-defective nozzle based on the signal output from the signal output circuit.

14. The liquid ejection apparatus according to claim 11, wherein, in a case that two or more second nozzle groups of the at least one second nozzle group satisfies the third condition, the controller is configured to:

classify remaining nozzles which are obtained by excluding one of the nozzles from each of the two or more second nozzle groups that satisfy the third condition, into at least one third nozzle group, each of the at least one third nozzle group including the two nozzles and having a combination of the nozzles different from those of the plurality of first nozzle groups and the two or more second nozzle groups; and the controller is configured to:

drive the liquid ejection head such that the liquid is simultaneously ejected from the two nozzles of each of the at least one third nozzle group; and judge whether the first condition is satisfied, the second condition is satisfied, or the third condition is satisfied based on the signal output from the signal output circuit.

15. The liquid ejection apparatus according to claim 14, wherein N is a natural number of not less than 3, the controller is configured to repeat:

classifying remaining nozzles obtained by excluding one nozzle from each of two or more [N−1]th nozzle groups which satisfy the third condition into at least one Nth nozzle group, each of the at least one Nth nozzle group including two nozzles and having a combination of the nozzles different from those of the first to [N−1]th nozzle groups;

driving the liquid ejection head such that the liquid is simultaneously ejected from the two nozzles in each of the at least one Nth nozzle group; and judging whether the first condition is satisfied, the second condition is satisfied, or the third condition is satisfied based on the signal output from the signal output circuit, until all of the at least one Nth nozzle group satisfy the first condition or the second condition, or only one Nth nozzle group in the at least one Nth nozzle group satisfies the third condition, and in a case that the controller judges that only one Nth nozzle group of the at least one Nth nozzle group satisfies the third condition, the controller is configured to:

drive the liquid ejection head such that the liquid is individually ejected from one of the two nozzles of the one Nth nozzle group; and judge whether or not each of the two nozzles of the one Nth nozzle group is the ejection-defective nozzle, based on the signal output from the signal output.

16. The liquid ejection apparatus according to claim 1, wherein:

N is a natural number of not less than 2; and the controller is configured to set the two or more nozzles of each of two or more Nth nozzle groups such that an average value of distances between the two or more nozzles is minimized.

17. The liquid ejection apparatus according to claim 1, wherein the liquid ejection head includes:

a plurality of nozzle arrays in which the plurality of nozzles are aligned in one direction; and a plurality of common channels corresponding to the plurality of nozzle arrays, and being in communication with the nozzles of the corresponding nozzle arrays, N is a natural number of not less than 2, and the controller is configured to set the two or more nozzles of at least one Nth nozzle group such that the two or more nozzles include nozzles in a same nozzle array.

18. The liquid ejection apparatus according to claim 17, wherein the controller is configured to set the two or more nozzles of the at least one Nth nozzle group such that the two or more nozzles include nozzles in the same nozzle array, and such that the nozzles are adjacent in the one direction.

19. The liquid ejection apparatus according to claim 1, wherein the plurality of nozzles includes nozzles of a plurality of types which eject different types of liquids, N is a natural number of not less than 2, and the controller is configured to set the two or more nozzles of at least one Nth nozzle group such that the two or more nozzles include nozzles, which discharge the liquid of a same type.

20. The liquid ejection apparatus according to claim 1, wherein N is a natural number of not less than 2, and the controller is configured to set the two or more nozzles of each of two or more Nth nozzle groups such that an average value of differences of elapsed times is minimized after the liquid ejection head is driven such that the liquid is ejected.

21. The liquid ejection apparatus according to claim 1, wherein the controller is configured to drive the liquid ejection head such that flashing is performed to discharge the liquid contained in the liquid ejection head from the ejection-defective nozzle.

22. The liquid ejection apparatus according to claim 21, wherein the liquid ejection head is configured to selectively perform, as the flashing, a first flashing and a second flashing in which a large amount of the liquid is discharged from the nozzles as compared with the first flashing;

the controller is configured to:

control the liquid ejection head to perform the first flashing such that the liquid is discharged from the ejection-defective nozzle;

drive the liquid ejection head such that the liquid is ejected from the ejection-defective nozzle after the first flashing; and judge whether or not the ejection-defective nozzle is recovered, based on the signal output from the signal output circuit, and the controller is configured to control the liquid ejection head to perform the second flashing such that the liquid is discharged from the unrecovered ejection-defective nozzle, in a case that the controller judges that at least one unrecovered ejection-defective nozzle is present.

23. The liquid ejection apparatus according to claim 21, further comprising:

a purge unit which performs a purge operation for ejecting the liquid contained in the liquid ejection head from the plurality of nozzles, wherein the controller is configured to:

drive the liquid ejection head such that the liquid is ejected from the ejection-defective nozzle after the flashing;

judge whether or not the ejection-defective nozzle is recovered based on the signal output from the signal output circuit; and control the purge unit to perform the purge operation, in a case that the controller judges that at least one ejection-defective nozzle, which is not recovered, is present.

24. The liquid ejection apparatus according to claim 1, wherein the controller is configured to judge whether or not the plurality of nozzles are the ejection-defective nozzles, at a first timing immediately before ejecting the liquid by the liquid ejection head from the plurality of nozzles toward a medium and at a second timing different from the first timing, in a case that the controller judges whether or not the plurality of nozzles are the ejection-defective nozzles at the second timing, and in a case that the controller judges that two or more first nozzle groups of the plurality of the first nozzle groups satisfies the third condition, the controller is configured to:

classify at least some of the nozzles of the two or more first nozzle groups which satisfy the third condition into the at least one second nozzle group;

drive the liquid ejection head such that the liquid is simultaneously ejected from the two or more nozzles of each of the at least one second nozzle group; and judge whether the first condition is satisfied, the second condition is satisfied, or the third condition is satisfied based on the signal output from the signal output circuit, and in a case that the controller judges whether or not the plurality of nozzles are the ejection-defective nozzles at the first timing, and in a case that the controller judges that at least one first nozzle group of the plurality of the first nozzle groups satisfies the third condition, the controller is configured to drive the liquid ejection head such that the flashing is performed to discharge the liquid contained in the liquid ejection head from the nozzle of the at least one first nozzle group which satisfies the third condition.

* * * * *